US009301579B2

(12) United States Patent
Fujii et al.

(10) Patent No.: US 9,301,579 B2
(45) Date of Patent: Apr. 5, 2016

(54) WATERPROOF SLIDE FASTENER

(75) Inventors: Takaaki Fujii, Toyama (JP); Kiyomasa Segawa, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 14/410,788

(22) PCT Filed: Jun. 28, 2012

(86) PCT No.: PCT/JP2012/066602

§ 371 (c)(1),
(2), (4) Date: Dec. 23, 2014

(87) PCT Pub. No.: WO2014/002234

PCT Pub. Date: Jan. 3, 2014

(65) Prior Publication Data

US 2015/0201718 A1 Jul. 23, 2015

(51) Int. Cl.
*A44B 19/32* (2006.01)
*A44B 19/02* (2006.01)

(52) U.S. Cl.
CPC ..... *A44B 19/32* (2013.01); *A44B 19/02* (2013.01); *Y10T 24/2514* (2015.01)

(58) Field of Classification Search
CPC ..... A44B 19/32; A44B 19/12; A44B 19/26; Y10T 24/2514; Y10T 24/2523
See application file for complete search history.

(56) References Cited

U.S. PATENT DOCUMENTS

| | | | | |
|---|---|---|---|---|
| 3,914,827 | A | 10/1975 | Brown et al. | |
| 4,520,535 | A * | 6/1985 | Kasai | 24/410 |
| 5,969,057 | A * | 10/1999 | Schoeley et al. | 525/474 |
| 2002/0100148 | A1 * | 8/2002 | Tominaga et al. | 24/391 |
| 2006/0260104 | A1 * | 11/2006 | Himi | 24/403 |
| 2008/0189918 | A1 | 8/2008 | Kusayama | |
| 2012/0272488 | A1 * | 11/2012 | Wang | 24/389 |
| 2013/0180087 | A1 * | 7/2013 | Matsuda et al. | 24/411 |

FOREIGN PATENT DOCUMENTS

| | | | |
|---|---|---|---|
| DE | 102007053020 | A1 | 5/2009 |
| JP | 60-198102 | A | 10/1985 |
| JP | 2000-041713 | A | 2/2000 |
| JP | 2008-194066 | A | 8/2008 |
| JP | 2010-012246 | A | 1/2010 |
| WO | 2011/064893 | A1 | 6/2011 |

OTHER PUBLICATIONS

International Search Report, PCT Application No. PCT/JP2012/066602, mailed Sep. 18, 2012.

* cited by examiner

*Primary Examiner* — Robert J Sandy
*Assistant Examiner* — Rowland Do
(74) *Attorney, Agent, or Firm* — Kilpatrick Townsend & Stockton LLP

(57) ABSTRACT

In a waterproof slide fastener, fastener elements are formed using a synthetic resin which contains a silicone resin or a fluorine-based resin, and a water repellant agent is applied to waterproof tapes and the fastener elements and hence, the waterproof slide fastener can exhibit a water-repellent effect brought about by the waterproof tapes and a water-repellent effect brought about by the fastener elements. Accordingly, it is possible to properly prevent the intrusion of a liquid through a gap formed between the left and right fastener elements and a gap formed between the fastener element and the waterproof tape.

3 Claims, 13 Drawing Sheets

WATERPROOF SLIDE FASTENER

This application is a national stage application of PCT/JP2012/066602, which is incorporated herein by reference.

TECHNICAL FIELD

The invention relates to a slide fastener having waterproof property (also referred to as water stopping property), and more particularly to a waterproof slide fastener provided with a waterproof structure which can prevent the intrusion of a liquid to a back surface side from a front surface side of the slide fastener or to the front surface side from the back surface side of the slide fastener.

BACKGROUND ART

A slide fastener provided with waterproof property (hereinafter referred to as a waterproof slide fastener) has been popularly used at an opening/closing portion or an opening formed on a product such as a bag to prevent the intrusion of a liquid such as water into the inside of the product at the time of closing the open/close portion or the opening. Here, "waterproof" means not only the prevention of intrusion of water but also the prevention of intrusion of a liquid other than water.

The waterproof slide fastener usually includes: a pair of left and right fastener stringers where an element row is formed on a waterproof tape having a waterproof layer made of a synthetic resin; and a slider which is slidable along the element rows, and also has the structure where the intrusion of a liquid into a tape back surface side from a tape front surface side (or into the tape front surface side from the tape back surface side) is prevented when the slider is slid so as to make the left and right element rows engage with each other.

With respect to such a waterproof slide fastener, various types of waterproof slide fasteners have been known conventionally. For example, U.S. Pat. No. 3,914,827 A (Patent Document 1), JP 2008-194066 A (Patent Document 2), DE 102007053020 A1 (Patent Document 3), and JP 2010-12246 A (Patent Document 4) disclose such a waterproof slide fastener.

For example, the waterproof slide fastener disclosed in Patent Document 1 and Patent Document 2 are configured such that an element row formed of coil-shaped continuous fastener elements is formed on the opposing tape edge portions (element attaching portions) of the left and right waterproof tapes. In the case of such a waterproof slide fastener where the element row is formed of coil-shaped fastener elements, when the left and right element rows are engaged with each other, the opposing tape edge portions of the left and right waterproof tapes are brought into close contact with each other so that the intrusion of water into a tape back surface side from a tape front surface side through between the left and right waterproof tapes is prevented.

Further, in Patent Document 1, there is the description that, in the waterproof slide fastener having the coil-shaped fastener elements, the fastener element and the element attaching portion of the fastener tape are covered with vulcanized silicone rubber. By covering the fastener element and the element attaching portion of the fastener tape by the vulcanized silicone rubber, when the coil-shaped fastener elements are seamed to the fastener tape, a plurality of holes (openings) formed in the fastener tape are clogged by the silicone rubber. Accordingly, the leakage of a liquid (water) to a tape back surface side from a tape front surface side through the plurality of holes can be prevented and hence, waterproof property of the slide fastener can be increased.

With respect to the waterproof slide fastener disclosed in Patent Document 2, there is the description that a water repellant agent or an oil repellant agent is applied to coil-shaped fastener elements, core threads which are made to pass through the inside of the fastener elements, and fastener tapes. Due to such applying of a water repellant agent or an oil repellant agent, for example, even when tape edge portions of left and right fastener tapes which are brought into close contact with each other are opened so that a gap is formed, the fastener elements, the core threads and the fastener tapes repel moisture or oil effectively and hence, the intrusion of moisture or oil to a tape back surface side from a tape front surface side through the gap can be prevented.

On the other hand, the waterproof slide fastener described in Patent Document 3 and Patent Document 4 is constituted such that an element row which is constituted of a plurality of independent fastener elements formed by injection-molding a synthetic resin is formed on the opposing tape edge portions (element attaching portions) of the left and right waterproof tapes.

For example, in the waterproof slide fastener disclosed in Patent Document 3, the plurality of fastener elements are fixedly attached to the opposing tape edge portions of the left and right waterproof tapes, and each fastener element is constituted of a first element half portion arranged on a tape front surface side (first tape surface side) of the waterproof tape and a second element half portion arranged on a tape back surface side (second tape surface side) of the waterproof tape.

In the fastener element of Patent Document 3, the first element half portion and the second element half portion have a face symmetry configuration with respect to the fastener tape. In making left and right element rows engage with each other by sliding the slider, the first element half portions of the left and right fastener elements are engaged with each other and the second element half portions of the left and right fastener elements are engaged with each other and, at the same time, the opposing tape edge portions of the left and right waterproof tapes are brought into close contact with each other. By bringing the tape edge portions of the left and right waterproof tapes into close contact with each other at the time of making the element rows engage with each other, liquid tightness between the left and right fastener stringers can be ensured and hence, the intrusion of a liquid to a tape back surface side from a tape front surface side can be prevented.

In Patent Document 3, a lubricant is contained in a synthetic resin used for forming the fastener element. In the waterproof slide fastener where the element row is constituted of the synthetic-resin-made fastener elements, at the time of closing the slide fastener, to make the element rows engage with each other and to bring the left and right waterproof tapes into close contact with each other as described above, it is necessary to make the slider slide by strongly pulling the left and right fastener elements to each other by making use of left and right flanges arranged on upper and lower blades of the slider.

The tape edge of the waterproof tape is arranged close to a coupling head of the fastener element and hence, when the slider is slid, a diamond which connects upper and lower blades of the slider to each other is liable to interfere with the waterproof tape. Accordingly, there exists a drawback that the slide resistance of the slider is increased at the time of closing the slide fastener. Accordingly, in Patent Document 3, a lubricant is contained in the fastener element as described previously and hence, a friction generated between the slider and the fastener element is reduced so that sliding property of the slider is improved.

In Patent Document 4, there is disclosed the waterproof slide fastener where the intrusion of a liquid through between left and right waterproof tapes is prevented by the left and right synthetic-resin-made fastener elements which are engaged with each other without bringing the left and right waterproof tapes into close contact with each other at the time of making element rows engage with each other.

To specifically explain the waterproof slide fastener disclosed in Patent Document 4 with reference to FIG. 13 and FIG. 14, the waterproof slide fastener 70 includes: a pair of left and right fastener stringers 71 where an element row 76 formed of a plurality of synthetic-resin-made fastener elements 73 is arranged on tape edge portions of left and right waterproof tapes 72 respectively; and a slider 77 which is attached to the element rows 76 and performs engaging and releasing of the left and right fastener elements 73.

The waterproof tape 72 disclosed in Patent Document 4 includes a core thread portion 72*a* along the tape edge. Further, a waterproof layer made of a waterproof material such as a synthetic resin is formed on a first tape surface side of the waterproof tape 72.

The fastener elements 73 disclosed in Patent Document 4 includes: a first element portion 74 arranged on a first tape surface side of the waterproof tape 72; and a second element portion 75 arranged on a second tape surface side of the waterproof tape 72, and the first element portion 74 and the second element portion 75 have the configurations different from each other.

As shown in FIG. 14, the first element portion 74 includes: a body portion 74*a* fixedly attached to the waterproof tape 72; a neck portion 74*b* projecting toward the outside of the tape from the body portion 74*a* and having a constricted shape such that an element width is narrowed; and a coupling head 74*c* further extending from the neck portion 74*b* and having an elongated circular shape.

As shown in FIG. 13, the second element portion 75 includes: a base portion 75*a* fixedly attached to the waterproof tape 72; and an element head 75*b* projecting toward the outside of the tape from the base portion 75*a*, and the element head 75*b* has the tapered configuration where an element width size (a size in the tape length direction) is gradually decreased toward a distal end.

In the waterproof slide fastener 70 disclosed in Patent Document 4 having such fastener elements 73, by sliding the slider 77 in the engaging direction of element rows 76, the first element portions 74 of the left and right fastener elements 73 are engaged with each other. Further, the second element portion 75 is inserted between the second element portions 75 arranged adjacent to each other on an engaging counterpart side such that the second element portion 75 is brought into contact with both neighboring second element portions 75 and, at the same time, the distal end of the element head 75*b* of the second element portion 75 is brought into contact with the core thread portion 72*a* of the waterproof tape 72 on a counterpart side.

Accordingly, in Patent Document 4, when the left and right element rows 76 are engaged with each other, the left and right waterproof tapes 72 are made to be separated from each other and hence, the increase of the slide resistance of the slider 77 can be suppressed. Further, when the left and right element rows 76 are engaged with each other, the first element portions 74 of the left and right fastener elements 73 are engaged with each other, and the left and right second element portions 75 are alternately engaged with each other such that the second element portions 75 cover a slight gap formed between the left and right first element portions 74 in an engaged state, and the distal end of each second element portion 75 is brought into contact with the core thread portion 72*a* of the waterproof tape 72 on a counterpart side.

By making the left and right fastener elements 73 engage with each other such that the first element portions 74 and the second element portions 75 are alternately engaged with each other and by making the left and right second element portions 75 alternately engage with each other extending over the left and right waterproof tapes 72, it is possible to prevent the formation of a straight-line-shaped gap which penetrates from an element front surface side to an element back surface side between the left and right waterproof tapes 72. Accordingly, although the left and right waterproof tapes 72 are separated from each other when the element rows 76 are engaged with each other, the intrusion of a liquid into a tape back surface side from a tape front surface side of the waterproof slide fastener 70 is minimally generated.

CITATION LIST

Patent Document

Patent Document 1: U.S. Pat. No. 3,914,827 A
Patent Document 2: JP 2008-194066 A
Patent Document 3: DE 102007053020 A1
Patent Document 4: JP 2010-12246 A

SUMMARY OF INVENTION

Technical Problem

In the case of the waterproof slide fastener of Patent Document 3 where the element row is formed of the synthetic-resin-made fastener elements, when the left and right element rows are engaged with each other, the left and right waterproof tapes are brought into close contact with each other and hence, the waterproof slide fastener can easily exhibit liquid tightness by which the intrusion of liquid can be prevented.

However, in the waterproof slide fastener where the left and right element rows are engaged with each other in a state where the left and right waterproof tapes are brought into close contact with each other, as described previously, the slide resistance of the slider is inevitably increased. Further, even when a lubricant is contained in a synthetic resin by which the fastener elements are formed so as to reduce a friction generated between the slider and the fastener elements, an operation of the slider at the time of making the element rows engage with each other or separating the element rows from each other becomes heavy and hence, there has been a demand for the further improvement in operability of the slider.

On the other hand, in the waterproof slide fastener 70 disclosed in Patent Document 4, even when the left and right element rows 76 formed of the synthetic-resin-made fastener elements 73 are engaged with each other, the left and right waterproof tapes 72 are in a separate state from each other and hence, the operation of the slider 77 at the time of making the element rows 76 engage with each other or separating the element rows 76 from each other can be performed relatively lightly.

Further, in the case of the waterproof slide fastener 70 disclosed in Patent Document 4, the configuration of the first element portion 74 of the fastener element 73 and the configuration of the second element portion 75 of the fastener element 73 are made different from each other so that when the left and right element rows 76 are engaged with each other, the formation of a straight-line-shaped gap which is formed in a penetrating manner from an element front surface side to an element back surface side can be prevented whereby the intrusion of a liquid is suppressed. However, even when the element rows 76 are engaged with each other, there has been a case where a gap is formed between the left and right fastener elements 73 which are engaged with each other in a state where the gap passes through in a meandering manner from an element front surface side to an element back surface side.

Accordingly, in the waterproof slide fastener 70 disclosed in Patent Document 4, for example, when a liquid enters the gap formed in the above-mentioned manner, the intrusion of a liquid into an element back surface side from an element front surface side is permitted through the gap. Accordingly, it is difficult for the waterproof slide fastener 70 to acquire the liquid tightness equivalent to the liquid tightness of the waterproof structure where the left and right waterproof tapes 72 are brought into close contact with each other disclosed in Patent Document 3, and there has been a demand for modification or improvement which can more effectively prevent the intrusion of a liquid.

The invention has been made in view of the above-mentioned drawbacks, and it is a specific object of the invention to provide a waterproof slide fastener which can effectively prevent the intrusion of a liquid by increasing liquid tightness while preventing the increase of the slide resistance of a slider.

Solution to Problem

To achieve the above-mentioned object, a waterproof slide fastener which the invention provides includes, as the basic structure, a pair of fastener stringers where a plurality of synthetic-resin-made fastener elements are attached to the opposing tape edge portions of the left and right waterproof tapes having a synthetic-resin-made waterproof layer on at least one of first and second tape surfaces; and a slider which is attached to element rows each of which is formed of the plurality of fastener elements, wherein each of the left and right fastener elements has an engaging portion which engages with the fastener element of an engaging counterpart, projects from a tape edge of the waterproof tape and is brought into contact with the tape edge portion of the engaging counterpart at the time of engaging of the element rows, the main technical feature of the present invention lies in that wherein a silicone resin or a fluorine-based resin is contained in the fastener element, and a water repellant agent is applied to the waterproof tape and the fastener element.

In the waterproof slide fastener according to the invention, it is preferable that the fastener element includes: a first element portion arranged on a first tape surface side of the waterproof tape, and a second element portion arranged on a second tape surface side of the waterproof tape and having a shape different from the first element portion, wherein the engaging portion is arranged on the first element portion, and the second element portion includes an element head which projects from the tape edge of the waterproof tape, is inserted between the fastener elements arranged adjacent to each other of the engaging counterpart and is brought into contact with the tape edge portion of the waterproof tape at the time of engaging of the element rows.

In the waterproof slide fastener according to the invention, it is preferable that the content of a silicone resin or a fluorine-based resin in the fastener element is set to 0.2 weight % or more and less than 1.5 weight %.

It is further preferable that a silicone resin or a fluorine-based resin is contained in the waterproof layer.

Advantageous Effect of Invention

In the waterproof slide fastener according to the invention, each of the left and right fastener elements has an engaging portion which engages with the fastener element of an engaging counterpart, projects from a tape edge of the waterproof tape and is brought into contact with the tape edge portion of the waterproof tape of the engaging counterpart (for example, a core thread portion of the waterproof tape of the engaging counterpart in the case where the core thread portion is arranged along the tape edge of the waterproof tape) at the time of engaging the element rows.

In the waterproof slide fastener according to the invention having such fastener elements, in the same manner as the above-mentioned Patent Document 4, the left and right waterproof tapes are brought into a state where these waterproof tapes are separated from each other when the left and right element rows are engaged with each other. Accordingly, it is possible to prevent the increase of the slide resistance of the slider and hence, an operation of the slider at the time of making the element rows engage with each other or separate from each other can be performed relatively lightly.

Further, in the waterproof slide fastener according to the invention, the fastener element having such a shape is made of a synthetic resin in which a silicone resin or a fluorine-based resin is contained, and a water repellant agent (also referred to as "water repellant and oil repellant agent) is applied to the waterproof tape and the fastener element.

That is, by applying a water repellant agent to the waterproof tape by coating, it is possible to prevent a liquid such as water from intruding into the waterproof tape. Further, since the water-repellent agent is applied to the waterproof tape and the fastener elements by coating, it is possible to effectively repel a liquid such as water on an outer surface of the waterproof tape and the fastener elements.

Accordingly, even when a gap is formed in a penetrating manner from an element front surface side to an element back surface side between the left and right fastener elements which are engaged with each other or between the fastener element and the waterproof tape of the engaging counterpart, it is possible to prevent the liquid from intruding into the gap by repelling the liquid by the waterproof tape and the fastener element.

On the other hand, the fastener elements of the invention are made of a synthetic resin and hence, even when a water repellant agent is applied to the fastener elements by coating, due to the presence of a surface tension of the water repellant agent or the like, there may be a case where it is difficult to uniformly apply the water repellant agent to the whole surfaces of the elements with a predetermined thickness thus generating irregularities in applying the water repellant agent. When such irregularities in the water repellant agent are generated, a region is formed where an effect of repelling a liquid by the water repellant agent (water-repellent effect) is partially decreased and hence, there arises a possibility that it is difficult to properly prevent the intrusion of the liquid into a gap formed between the left and right fastener elements or a gap formed between the fastener element and the waterproof tape of the engaging counterpart.

To overcome such drawbacks brought about by irregularities in applying such a water repellant agent, in the waterproof slide fastener according to the invention, as described previously, in the fastener element, a silicon resin or a fluorine-based resin capable of imparting water repellency to the fastener element is contained. Due to such a constitution, the fastener element can acquire not only a water-repellent effect brought about by a water repellant agent but also a water-repellent effect brought about by a contained silicone resin or a contained fluorine-based resin and hence, it is possible to prevent such a water-repellent effect from being partially decreased even when the above-mentioned irregularities in applying a water repellant agent is generated on the surface of the element.

Accordingly, in the waterproof slide fastener according to the invention, the operability of the slider becomes smooth. At the same time, even when a liquid intends to intrude into a gap formed between the left and right fastener elements or a gap formed between the fastener element and the waterproof tape of the engaging counterpart, the waterproof slide fastener can exhibit the water-repellent effect brought about by the waterproof tape and the water-repellent effect brought about by the fastener element in a stable manner and hence, the intrusion of such a liquid can be properly prevented whereby liquid tightness of the waterproof slide fastener can be enhanced.

In the waterproof slide fastener according to the invention having such a constitution, the fastener element includes: a first element portion arranged on a first tape surface side of the waterproof tape, and a second element portion arranged on a second tape surface side of the waterproof tape and having a shape different from the first element portion. Further, the engaging portion which engages with the faster element of the engaging counterpart is arranged on the first element portion. Still further, the second element portion includes an element head which projects from the tape edge of the waterproof tape, is inserted between the fastener elements arranged adjacent to each other of the first element portion of an engaging counterpart and is brought into contact with the tape edge portion of the waterproof tape at the time of engaging of the element rows (for example, a core thread portion of the waterproof tape of the engaging counterpart in the case where the core thread portion is arranged along the tape edge of the waterproof tape).

Since the fastener element of the present invention has such a constitution, when the left and right element rows are engaged with each other, the first element portions of the left and right fastener elements are engaged with each other and, at the same time, the left and right second element portions are engaged with each other alternately so as to cover a slight gap formed between the left and right first element portions in an engaged state, and a distal end of the element head of each second element portion is brought into contact with the tape edge portion of the waterproof tape on a counterpart side.

Accordingly, the waterproof slide fastener of the invention can ensure sliding property of the slider by maintaining a state where the left and right waterproof tapes are separated from each other and can prevent the formation of a gap between the left and right waterproof tapes in such a manner that the gap penetrates from an element front surface side to an element back surface side in the straight direction. Accordingly, it is possible to more effectively prevent the intrusion of a liquid through a gap formed between the left and right fastener elements and through a gap formed between the fastener element and the waterproof tape on an engaging counterpart side.

Further, in the waterproof slide fastener of the invention, the content of a silicone resin or a fluorine-based resin in the fastener element is set to 0.2 weight % or more and less than 1.5 weight %. By setting the content of a silicone resin or a fluorine-based resin to 0.2 weight % or more, a water-repellent effect brought about by a silicone resin or a fluorine-based resin can be exhibited in a stable manner. Further, by setting the content of a silicone resin or a fluorine-based resin to less than 1.5 weight %, the strength of the fastener element can be ensured in a stable manner.

Still further, in the waterproof slide fastener of the invention, a silicone resin or a fluorine-based resin is also contained in the inside of the waterproof layer and hence, it is possible to impart a water-repellent effect to the waterproof layer per se and hence, it is possible to more effectively prevent the intrusion of a liquid to a tape front surface side from a tape back surface side of the waterproof slide fastener (to a tape back surface side from a tape front surface side of the waterproof slide fastener).

DESCRIPTION OF EMBODIMENT

Hereinafter, preferred embodiments of the invention are described in detail by reference to drawings. The invention is not limited to the embodiments described hereinafter in any ways, and various modifications are conceivable provided that the modifications substantially have the same constitution as the invention and can acquire the substantially same manner of operation and advantageous effect as the invention.

For example, in the embodiment described hereinafter, the description is made with respect to a waterproof slide fastener where a bottom end stop is arranged at one end portions of element rows, and stoppers are arranged at the other end portions of the element rows. However, the invention also includes a waterproof slide fastener where a stopper is arranged at both end portions of element rows and a waterproof slide fastener where a stopper is arranged only an end portion of either one of element rows. Further, in the invention, a specific shape or a specific size of a fastener element can be desirably changed.

Figure 1:
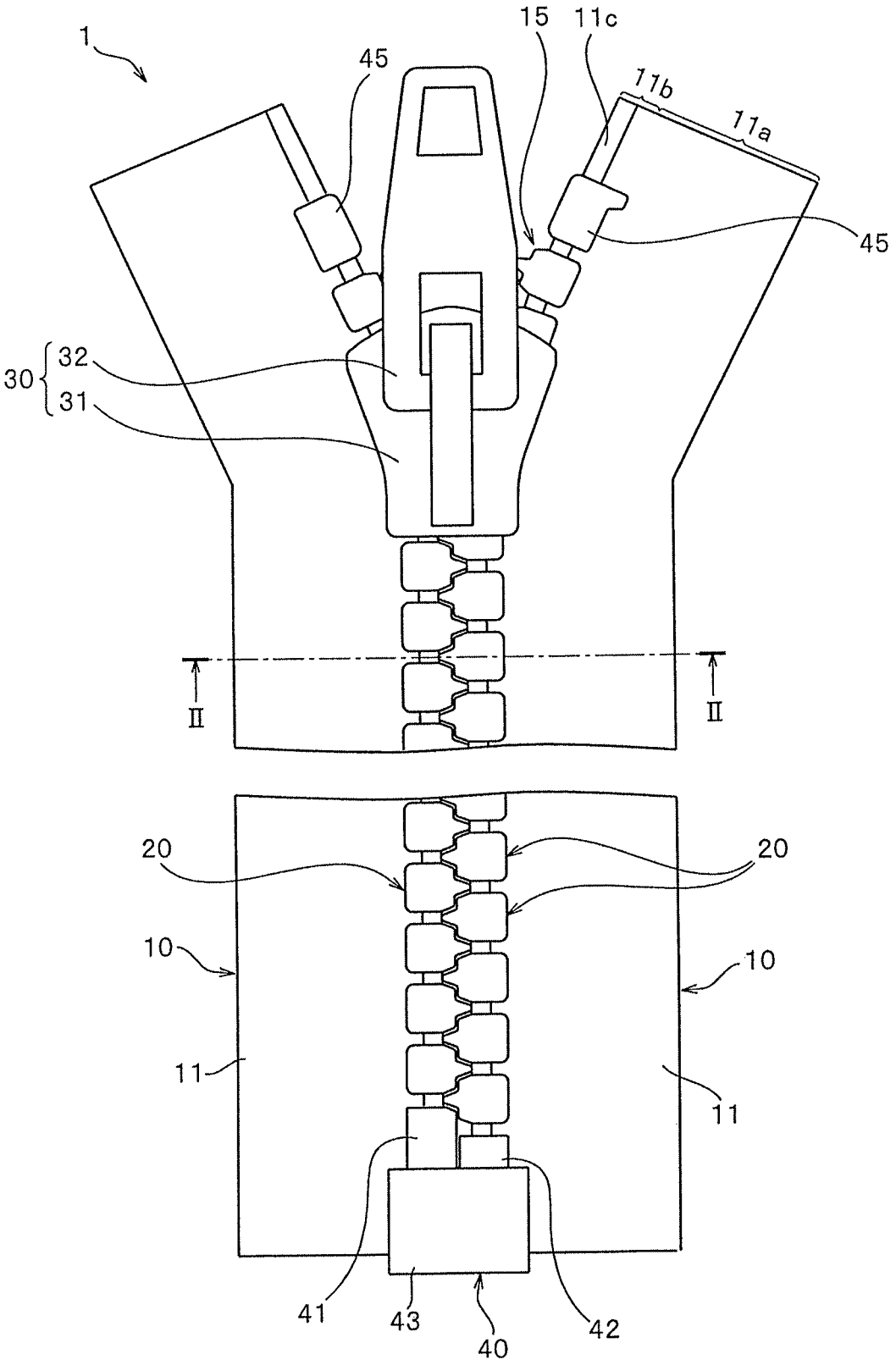
FIG. 1 is a plan view showing a waterproof slide fastener according to a first embodiment of the invention.
Figure 2:
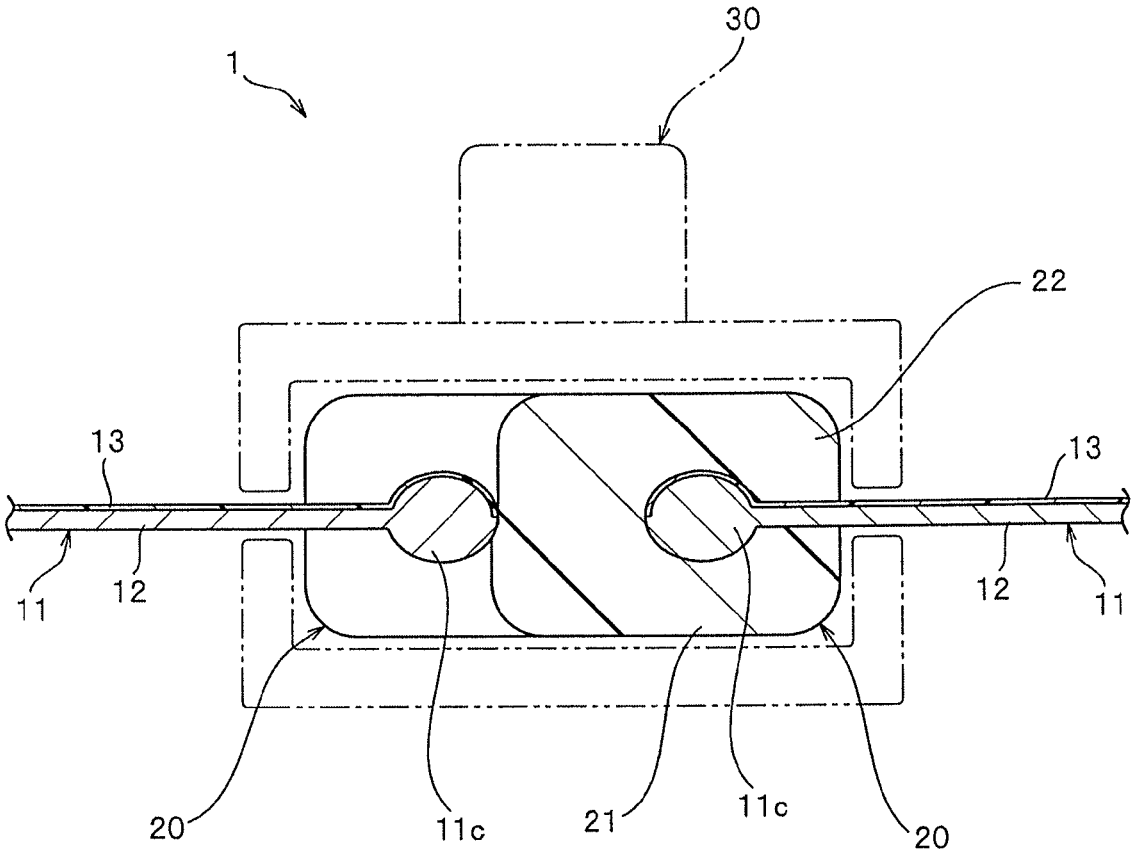
FIG. 2 is a cross-sectional view taken along line II-II in FIG. 1.
Figure 3:
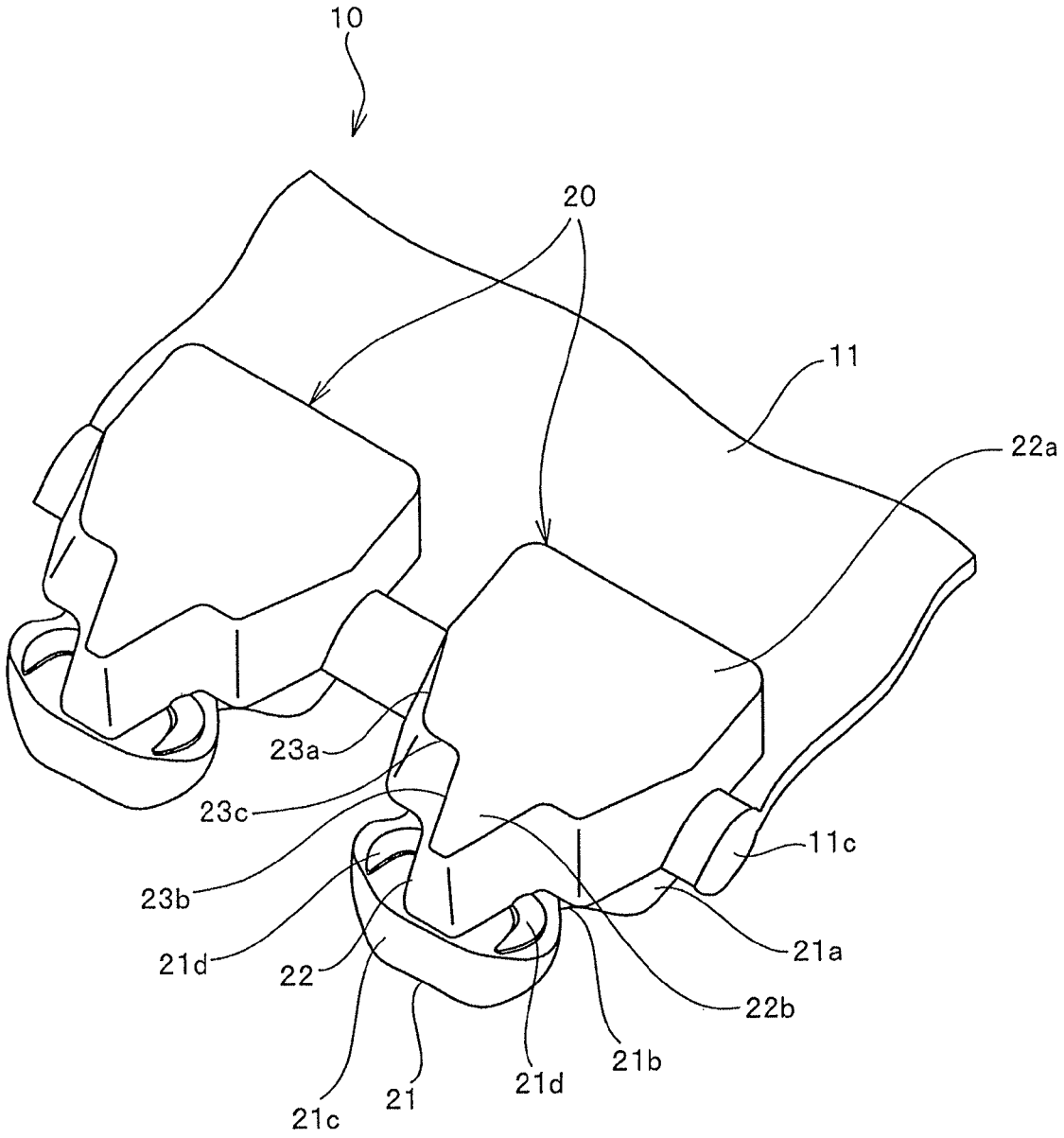
FIG. 3 is a perspective view showing a fastener element of the waterproof slide fastener in an enlarged manner.
Figure 4:
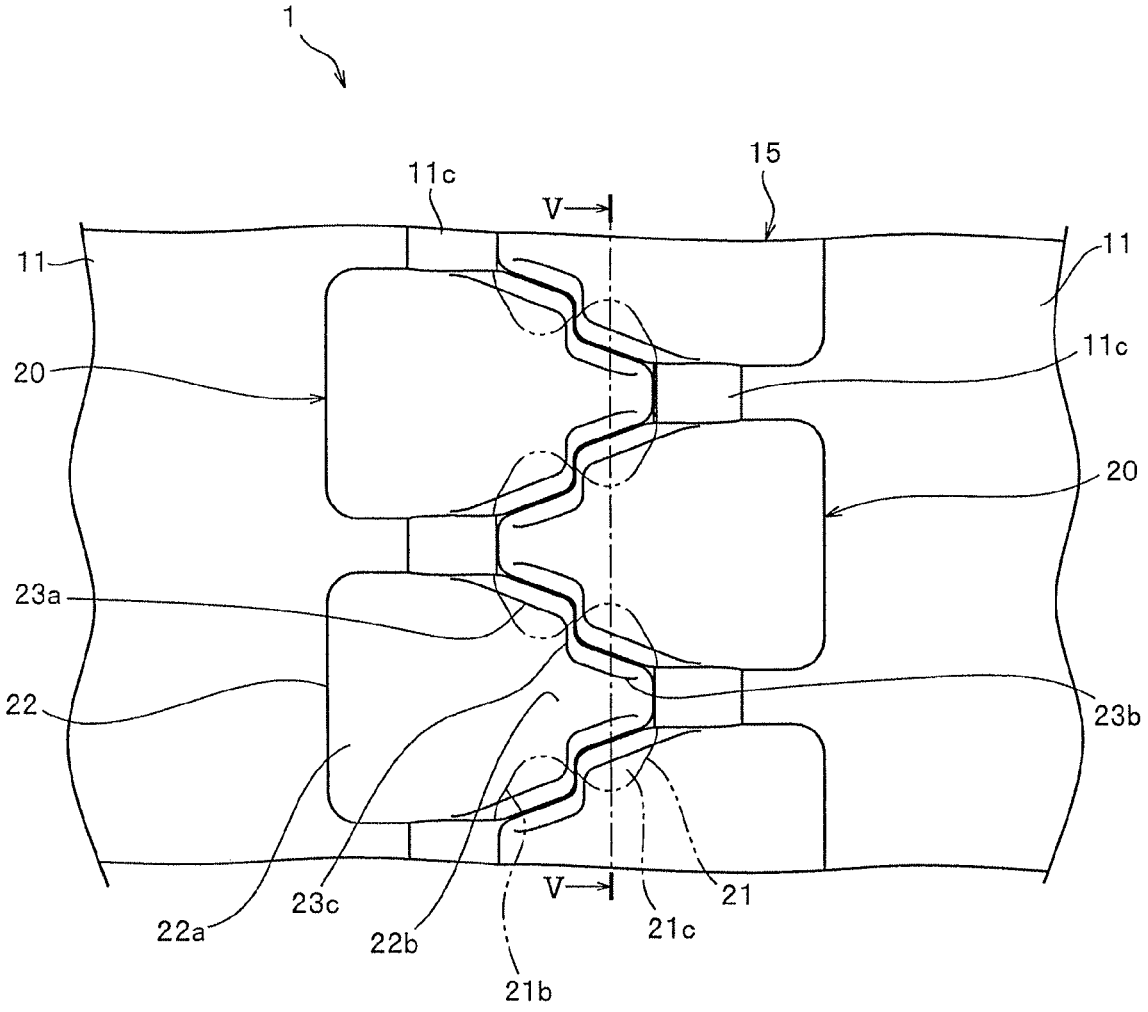
FIG. 4 is an enlarged view of an essential part showing a state where left and right element rows of the waterproof slide fastener are engaged with each other in an enlarged manner.

FIG. 1 is a plan view showing a waterproof slide fastener 1 according to a first embodiment of the invention. FIG. 2 is a cross-sectional view taken along line II-II in FIG. 1. FIG. 3 is a perspective view showing a fastener element 20 of the waterproof slide fastener 1 in an enlarged manner. FIG. 4 is an enlarged view of an essential part showing a state where left and right element rows 15 are engaged with each other in an enlarged manner.

In the description made hereinafter, the longitudinal direction indicates the length direction of a waterproof tape 11, and the longitudinal direction is the same direction as the sliding direction along which a slider 30 slides. Particularly, the direction along which the slider 30 is slid so as to close the waterproof slide fastener 1 by making the left and right element rows 15 engage with each other is assumed as a frontward direction, and the direction along which the slider 30 is slid so as to open the waterproof slide fastener 1 by separating the left and right fastener elements 20 from each other is assumed as a rearward direction.

The lateral direction indicates the tape width direction of the waterproof tape 11, and is the direction parallel to a tape surface of the waterproof tape 11 and orthogonal to the tape length direction. The vertical direction indicates the front-and-back direction of the waterproof tape 11 orthogonal to the tape surface of the waterproof tape 11. Particularly, the direction toward a side where a tab 32 of the slider 30 is arranged with respect to the waterproof tape 11 is assumed as the upward direction, and the direction opposite to the upper direction is assumed as the downward direction.

The waterproof slide fastener 1 according to the first embodiment is attached to an opening/closing portion or an opening formed on a fastener attached product such as a bag. When the waterproof slide fastener 1 is closed, the waterproof slide fastener 1 exhibits waterproof property for preventing the intrusion of a liquid such as water from the outside of the fastener attached product into the inside of the fastener attached product (or from the inside of the fastener attached product to the outside of the fastener attached product) through the waterproof slide fastener 1.

The waterproof slide fastener 1 according to the first embodiment includes: a pair of left and right fastener stringers 10 where a plurality of synthetic-resin-made fastener elements 20 are formed by injection molding on the opposing tape edge portions 11*b* of the waterproof tapes 11; a slider 30 which is arranged in a slidable manner along the element rows 15 formed of the plurality of fastener elements 20; a bottom end stop 40 arranged on a rear end portion side of the element rows 15; and stoppers (upper stoppers) 45 arranged on a front end portion side of the element rows 15.

The waterproof tape 11 according to the first embodiment includes; a tape main body portion 11*a* which constitutes a portion to be attached to a fastener attached product; and a tape edge portion (also referred to as element attaching portion) 11*b* which is arranged on an inner side of the tape main body portion 11*a*. A bulged core thread portion 11*c* is formed on a tape edge on a tape edge portion 11*b* side (a tape inner side edge of the waterproof tape 11) along the tape length direction.

The waterproof tape 11 is configured such that a waterproof layer 13 made of polyurethane-based thermoplastic elastomer, polyester-based thermoplastic elastomer, polyamide-based thermoplastic elastomer or vinyl chloride-based thermoplastic elastomer is laminated on a tape front surface (second tape surface) of a fastener tape 12 formed by weaving or knitting.

In this embodiment, the waterproof layer 13 having a fixed thickness is laminated on the whole front surface of the fastener tape 12 including the core thread portion 11*c*. Such a waterproof layer 13 can be easily formed by adhering or welding a film made of thermoplastic elastomer, for example, to the tape front surface of the fastener tape 12.

The waterproof layer 13 of the waterproof tape 11 is made of thermoplastic elastomer as described above and hence, it is possible to impart waterproof property to the waterproof tape 11 per se and, at the same time, flexibility of the waterproof tape 11 is ensured so that the waterproof tape 11 can be bent in the tape front-and-back direction or in the tape width direction whereby the waterproof slide fastener 1 can be easily handled. Further, by arranging thermoplastic elastomer on the tape front surface side of the waterproof tape 11, it is possible to fixedly adhere the tape front surface of the waterproof tape 11 and a fastener attached product to each other by high-frequency welding or the like.

A silicone resin or a fluorine-based resin is contained in thermoplastic elastomer used for forming the waterproof layer 13 at a predetermined ratio. In this case, it is preferable that the content of silicone resin or fluorine-based resin in the waterproof layer 13 be set to 2.0 weight % or more and less than 4.0 weight %. By making the waterproof layer 13 contain a silicone resin or a fluorine-based resin at the predetermined ratio in this manner, the waterproof layer 13 can exhibit desired strength and desired water repellency.

In the first embodiment, the waterproof layer 13 is formed only on the tape front surface side of the waterproof tape 11 which constitutes one tape surface (second tape surface). However, in the invention, the waterproof layer 13 may be formed only on a tape back surface side of the waterproof tape 11 which constitutes the other tape surface (first tape surface), or may be formed on both the tape front surface and the tape back surface of the waterproof tape 11. Further, the waterproof layer 13 may be formed on a partial region of the tape surface as in the case of a second embodiment described later instead of forming the waterproof layer 13 on the whole surface of either one of tape surfaces of the waterproof tape 11.

The element row 15 formed on the waterproof tape 11 is formed such that a plurality of fastener elements 20 are attached to the waterproof tape 11 at a predetermined attachment pitch along the tape length direction by injection molding. In this case, an attachment pitch of the fastener elements 20 is set smaller than an interval between the fastener elements 20 arranged adjacent to each other in the tape length direction when the left and right element rows 15 are engaged with each other.

That is, in the waterproof slide fastener 1 of the first embodiment, the interval between the fastener elements 20 when the element rows 15 are engaged with each other is set to be extended compared with the interval between the fastener elements 20 before the element rows 15 are engaged with each other by making use of extension and contraction of the waterproof tape 11.

Due to such interval setting, when the element rows 15 are engaged with each other, the left and right fastener elements 20 are engaged with each other in such a manner that each fastener element 20 is pushed into between the fastener elements 20 of the engaging counterpart arranged adjacent to each other while expanding a gap formed between the fastener elements 20 so that the left and right fastener elements 20 are strongly brought into contact with each other. Accordingly, the gap formed between the left and right fastener elements 20, particularly, a gap formed between second element portions 22 of the left and right fastener elements 20 described later can be made small, or a gap is minimally formed between the second element portions 22 of the left and right fastener elements 20.

The fastener element 20 of the first embodiment includes: a first element portion 21 arranged on a tape back surface (first tape surface) side of the waterproof tape 11; and a second element portion 22 arranged on a tape front surface (second tape surface) side of the waterproof tape 11 with the tape edge portion 11*b* of the waterproof tape 11 interposed between the first element portion 21 and the second element portion 22.

The first and second element portions 21, 22 are fixedly attached to the waterproof tape 11 respectively. Further, the first and second element portions 21, 22 are integrally connected to each other at portions of the first and second element portions 21, 22 which project from the tape inner side edge of the waterproof tape 11 and, at the same time, are integrally connected to each other through holes formed in the tape edge portion 11*b* of the waterproof tape 11 (not shown in the drawing). In this case, the position of a boundary between the first element portion 21 and the second element portion 22 is set lower than the center position of the waterproof tape 11 in the tape front-and-back direction. A size of the element portion which projects from the tape inner side edge (a length from the tape inner side edge to a distal end of the first or second element portion 21, 22) is set larger than an interval between the left and right tape inner side edges which face each other at the time of engaging.

The first element portion 21 of the fastener element 20 includes: a body portion 21*a* fixedly attached to the waterproof tape 11; a neck portion 21*b* which is contiguously formed with the body portion 21*a*, and has a constricted shape where an element width (a size of the element in the tape length direction) is narrowed; and a coupling head 21*c* which is contiguously formed with the neck portion 21*b*, and has an elliptical shape as viewed in a bottom view.

In this first element portion 21, an engaging portion which is engaged with the fastener element 20 constituting an engaging counterpart is formed of the coupling head 21*c* and the neck portion 21*b*. In the invention, the engaging portion of the first element portion may have other shapes or other structures.

Figure 5:
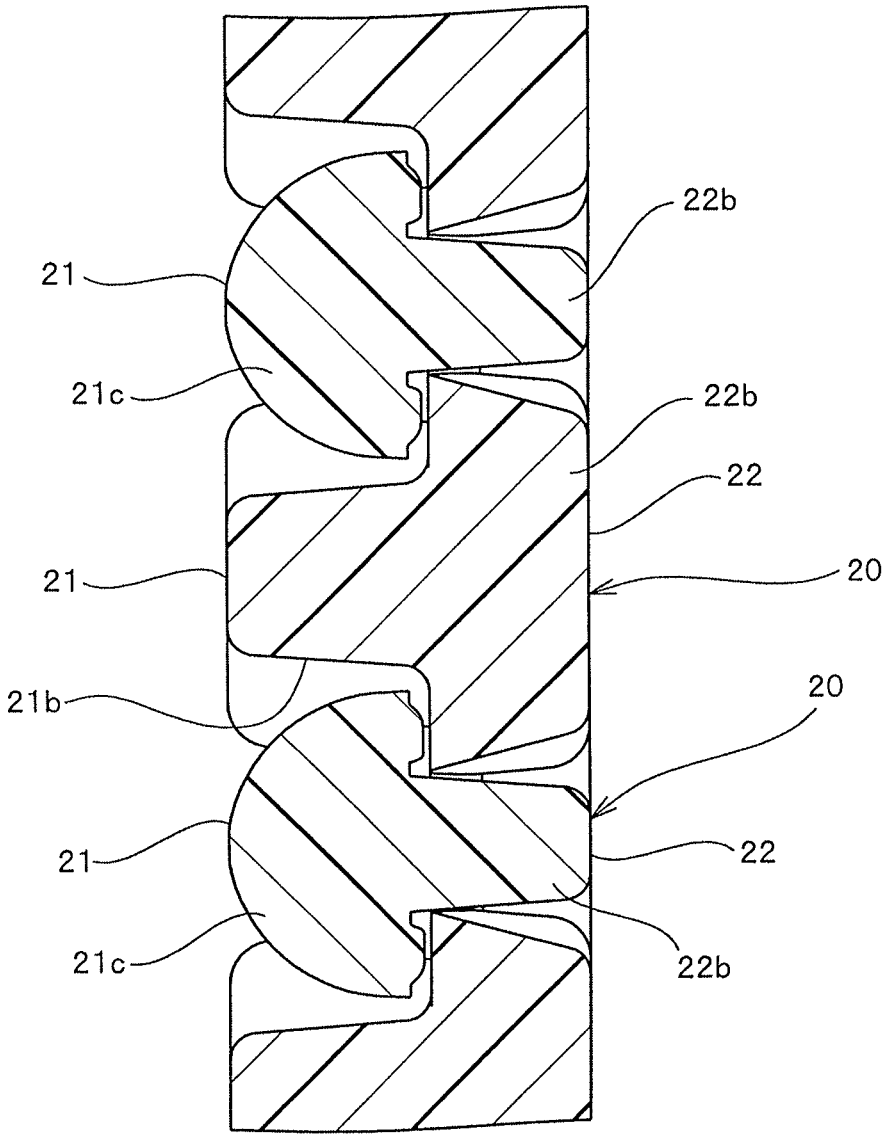
FIG. 5 is a cross-sectional view taken along line V-V in FIG. 4.

As shown in FIG. 3, on an upper surface of the coupling head 21*c* of the first element portion 21 of each fastener element 20, a pair of front and rear raised portions 21*d* is arranged, wherein the raised portions 21*d* are formed into a tapered shape while being curved into a fang shape from the second element portion 22. By arranging such a pair of raised portions 21*d* on the coupling head 21*c*, when the left and right element rows 15 are engaged with each other, it is possible to make the raised portions 21*d* approach or brought into contact with a lower surface of the second element portion 22 of the fastener element 20 of the engaging counterpart (particularly, the element head 22*b* of the second element portion 22 described later) as shown in FIG. 5. Accordingly, it is possible to narrow a gap formed between the left and right fastener elements 20 and penetrating in a meandering manner from an element front surface side to an element back surface side. Alternatively, it is possible to close the gap between the element front surface side and the element back surface side.

The second element portion 22 of the fastener element 20 is formed into a shape different from the shape of the first element portion 21. The second element portion 22 of the fastener element 20 includes: a base portion 22*a* fixedly attached to the waterproof tape 11; and an element head 22*b* extending in the tape width direction from the base portion 22*a* so as to project from the tape inner side edge of the waterproof tape.

The base portion 22*a* of the second element portion 22 has a substantially rectangular parallelepiped shape. As shown in FIG. 4, a size in the tape length direction of a lower end portion of the base portion 22*a* which is brought into contact with the waterproof tape 11 is set to an approximately fixed value over the whole base portion 22*a* in the tape width direction. By setting the size of the lower end portion of the base portion 22*a* as described above, the strength of fixing the base portion 22*a* to the waterproof tape 11 is ensured.

The element head 22*b* of the second element portion 22 has a shape where an element width is gradually reduced in two stages toward a distal end of the element head 22*b*. The element head 22*b* of the second element portion 22 includes: a first gradually decreasing portion 23*a* formed on a base portion 22*a* side; and a second gradually decreasing portion 23*b* formed on a distal end side of the element head 22*b* starting from the first gradually decreasing portion 23*a* by way of a stepped portion 23*c*.

Element side surfaces (front surface and rear surface) of the first gradually decreasing portion 23*a* and element side surfaces of the second gradually decreasing portion 23*b* are formed into an inclined surface where an element width is gradually reduced toward an element upper surface. In this case, the inclined surface of the first gradually decreasing portion 23*a* extends to a portion of a side surface of the base portion 22*a*.

Further, the second element portion 22 has a shape and size where, when the left and right fastener elements 20 are engaged with each other, as shown in FIG. 4, the second element portion 22 is inserted into between the second element portions 22 of the fastener elements 20 of the engaging counterpart and arranged adjacent to each other in the tape length direction, the element side surfaces of the second element portion 22 are brought into contact with both second element portions 22 of the engaging counterpart, and a distal end of the element head 22*b* is brought into contact with the core thread portion 11*c* of the waterproof tape 11 of the engaging counterpart.

In this case, the distal end of the element head 22*b* is formed parallel to the tape length direction, and the position of the distal end of the element head 22*b* in the tape width direction is set closer to the waterproof tape 11 than the distal end position of the coupling head 21*c* of the first element portion 21.

By setting the relative positional relationship between the distal end of the element head 22*b* and the distal end of the coupling head 21*c* in this manner, when the left and right element rows 15 are engaged with each other, the first element portions 21 of the left fastener elements 20 and the first element portions 21 of right fastener elements 20 can be stably engaged with each other and, at the same time, the distal end of the element head 22*b* of the second element portion 22 can be brought into contact with the core thread portion 11*c* of the waterproof tape 11 of the engaging counterpart. Further, it is possible to prevent the formation of a gap which penetrates linearly from a front surface side to a back surface side between the fastener element 20 and the waterproof tape 11 of the engaging counterpart.

The fastener element 20 having the above-mentioned shape is formed on the waterproof tape 11 by injection molding using a material where a silicone resin or a fluorine-based resin is contained in a thermoplastic resin such as polyacetal, polyamide, polypropylene, polybutylene terephthalate, nylon or polycarbonate.

Particularly, in the case of the first embodiment, polyacetal containing dimethyl silicone is used as a silicone resin. In this manner, a silicone resin or a fluorine-based resin is contained in a thermoplastic resin for forming the fastener element 20, it is possible to impart water-repellent effect for repelling water to the whole outer surface of the fastener element 20. The silicone resin may also be referred to as silicone oil in general.

In this case, the content of silicone resin or fluorine-based resin in a material for forming the fastener element 20 is set to 0.2 weight % or more and less than 1.5 weight %, and is preferably set to 0.3 weight % or more and to 1.0 weight % or less. By setting the content of silicone resin or fluorine-based resin to 0.2 weight % or more, the fastener element 20 can stably exhibit a water-repellent effect brought about by a silicone resin or a fluorine-based resin. Further, by setting the content of silicone resin or fluorine-based resin to less than 1.5 weight %, strength of the fastener element 20 can be stably ensured. In the first embodiment, the content of silicone resin (dimethyl silicone) is set to 0.3 weight %. The content of silicone resin or fluorine-based resin in a material for forming the fastener element 20 can be detected by X-ray Fluorescence Spectrometers (XRF).

In the waterproof slide fastener 1 of the first embodiment, a water-repellent agent is applied by coating to the whole outer surface of the waterproof tape 11 and the whole outer surface of the fastener element 20. In this case, as a water-repellent agent, a fluorine-based compound, a silicone-based compound, an acrylic water-repellent agent, a silicone composite water-repellent agent, a paraffinic compound, an ethylene urea-based compound, a zirconium-based compound, a fatty acid amide-based compound, a methylol amide-based compound, an alkyl urea type water-repellent agent, a fatty acid amide type water-repellent agent or the like can be used. Particularly, in the first embodiment, a fluorine-based water-repellent agent which can be easily handled and has excellent heat resistance and excellent chemical resistance is used as a water-repellent agent applied to the waterproof tape 11 and the fastener element 20 by coating.

Further, to enhance durability of a water-repellent agent, a water-repellent agent may contain a cross-linking agent such as a melamine resin, a blocked isocyanate-based resin or an imine-based resin, or a binder resin such as an acrylic resin, a urethane resin or silicone resin.

In the invention, a method of applying a water-repellent agent to the waterproof tape 11 and the fastener element 20 by coating is not particularly limited. For example, a water-repellent agent may be applied to the waterproof tape 11 and the fastener element 20 by coating using a method substantially equal to a water-repellent treatment process described in patent document 2 or using other methods.

In this manner, by applying a water-repellent agent to the waterproof tape 11 by coating, a liquid such as water is repelled by the front surface or the rear surface of the waterproof tape 11 and hence, it is possible to prevent a liquid such as water from intruding into the waterproof tape 11. Further, the water-repellent agent is applied to the fastener element 20 by coating and hence, it is possible to effectively repel a liquid such as water by the outer surface of the fastener element 20. Particularly, in this case, the water-repellent agent is applied to portions of the left and right fastener elements 20 which are brought into contact with each other or portions of the left and right fastener elements 20 which face each other in an opposed manner and hence, when a gap is formed between the left and right fastener elements 20, it is possible to effectively repel a liquid at a peripheral portion of the gap.

There may be a case where a gap which penetrates from an element front surface side to an element back surface side in a meandering manner, for example, is formed between the left and right fastener elements 20 or between the fastener element 20 and the waterproof tape 11 of the engaging counterpart when the element rows 15 are engaged with each other. Even in such a case, it is possible to prevent the intrusion of a liquid into the gap.

When it is necessary to check whether or not a water-repellent agent is applied to the waterproof tape 11 or the fastener element 20, for example, a proper amount of water drops is dripped on a front surface of a portion to be examined and a contact angle of the droplet is calculated from a shape of the droplet formed on the front surface. Due to such an operation, it is possible to distinguish whether or not a water-repellent agent is applied.

In this embodiment, "contact angle" means an angle made by a tangent line in the vicinity of a front surface of a droplet and a front surface of a member. The larger the contact angle, the higher water repellency that the member exhibits. Water repellency can becomes apparent by actually comparing a specimen to which a water-repellent agent is applied and a specimen to which no water-repellent agent is applied with each other. Usually, a contact angle of a member to which no water-repellent agent is applied is 30° or less. When it is recognized by the method that the water-repellent agent is applied or that there is a possibility that the water-repellent agent be applied, the presence or non-presence of an applied material (water-repellent agent) on a front surface of a member may be detected by an analysis.

The presence or non-presence of the applied water-repellent agent can be also analyzed by detecting a material applied to the front surface by an energy dispersive X-ray analysis. For example, by performing the X-ray analysis, fluorine (F) is detected when a fluorine-based compound is used as a water-repellent agent, while silicon (Si) is detected when a silicone-based compound is used as a water-repellent agent.

As the slider 30 in the first embodiment, a slider substantially equal to a slider generally used in a conventional waterproof slide fastener is used. That is, the slider 30 includes: a slider body 31; and a tab 32 which is rotatably held by the slider body 31.

The slider body 31 includes: upper and lower blades; a diamond which connects end portions of the upper and lower blades on a shoulder opening side; left and right upper flange portions arranged at left and right side edge portions of the upper blade; left and right lower flange portions arranged at left and right side edge portions of the lower blade; and a tab mounting column which is erected on an upper surface side of the upper blade and by which the tab 32 is held.

Left and right shoulder openings are formed at a front end of the slider body 31 with the diamond interposed therebetween, and a rear opening is formed at a rear end of the slider body 31. An element guide path having an approximately Y shape which communicably connects the left and right shoulder openings and the rear opening is formed between the upper and lower blades. A tape inserting gap through which the left and right waterproof tapes 11 are inserted is formed between the upper flange portion and the lower flange portion of the slider body 31.

The bottom end stop 40 is arranged on a rear end portion side of the element row 15 so as to determine a rear end position of a sliding range of the slider 30. The bottom end stop 40 includes: an separable pin 41 attached to a rear end portion of one fastener stringer 10 (on a left side) such that the separable pin 41 is arranged adjacent to the element row 15; a box pin 42 attached to a rear end portion of the other fastener stringer 10 (on a right side) such that the box pin 42 is arranged adjacent to the element row 15; and a box 43 integrally formed with the rear end portion of the box pin 42. The box 43 is configured such that the separable pin 41 can be inserted into and removed from the box 43.

The stopper 45 is attached to a front end portion of each one of left and right fastener stringers 10 adjacent to the element row 15 so as to prevent the removal of the slider 30 from a front end side of the element row 15. In the first embodiment, the bottom end stop 40 and the stopper 45 are formed by injection-molding a synthetic resin material which is equal to a material for forming the fastener element 20 to the waterproof tape 11, and a water-repellent agent is applied by coating to the whole outer surface of the bottom end stop 40 and the whole outer surface of the stopper 45. In the invention, the constitutions of the slider 30, the bottom end stop 40, and the stopper 45 are not particularly limited, and can be desirably changed.

In the waterproof slide fastener 1 according to the first embodiment having the above-mentioned constitution, as shown in FIG. 2 and FIG. 4, when the left and right element rows 15 are engaged with each other, the left and right waterproof tape 11 are not brought into close contact with each other and are separated from each other. Accordingly, in the waterproof slide fastener 1, a sliding resistance of the slider 30 generated at the time of sliding the slider 30 in the engaging direction of the element rows 15 or in the separating direction of the element rows 15 can be made small compared with a waterproof slide fastener described in Patent Document 3, for example, where left and right waterproof tapes are brought into close contact with each other. Due to such a constitution, the slider 30 can be operated relatively lightly.

In the waterproof slide fastener 1, as shown in FIG. 4, when the left and right element rows 15 are engaged with each other, the left and right first element portions 21 are engaged with each other and, at the same time, the left and right second element portions 22 are engaged with each other in a contact state so as to cover a small gap formed between the left and right first element portions 21 in an engaged state.

Further, the distal end of the element head 22*b* of each second element portion 22 is brought into contact with the core thread portion 11*c* of the waterproof tape 11 of the counterpart and, at the same time, the coupling head 21*c* of the first element portion 21 is formed such that the coupling head 21*c* projects from the element head 22*b* in the longitudinal direction toward an engaging counterpart side. Accordingly, it is possible to prevent the formation of a gap which penetrates linearly from the front surface side to the back surface side between the fastener element 20 and the waterproof tape 11 of the counterpart.

Still further, as described above, an attachment pitch of the fastener elements 20 is set smaller than an interval between the fastener elements 20 when the left and right element rows 15 are engaged with each other and hence, at the time of making the element rows 15 engage with each other, the respective fastener elements 20 can be strongly engaged with each other such that each fastener element 20 wedges between the fastener elements 20 of the engaging counterpart arranged adjacent to each other. Due to such a constitution, it is possible to narrow a gap formed in a penetrating and meandering manner from the element front surface side to the element back surface side or it is possible to make such a gap minimally formed.

Further, a water-repellent agent is applied to the waterproof tapes 11 and the fastener elements 20 of the waterproof slide fastener 1 by coating and hence, it is possible to prevent a liquid such as water from intruding into waterproof tape 11 and, at the same time, it is possible to effectively repel a liquid such as water by the element front surface. The waterproof tape 11 and the fastener element 20 of the waterproof slide fastener 1 exhibit a water-repellent effect brought about by such a water-repellent agent and hence, even when a gap is formed between the left and right fastener elements 20 which are engaged with each other or between the fastener element 20 and the waterproof tape 11 of the counterpart, it is possible to suppress the intrusion of a liquid into the gap.

In the fastener element 20 of the waterproof slide fastener 1, a silicone resin or a fluorine-based resin is contained in a thermoplastic resin used for forming the fastener element 20. Accordingly, the fastener element 20 can exhibit not only a water-repellent effect brought about by a water-repellent agent but also a water-repellent effect brought about by a silicone resin or a fluorine-based resin contained in a thermoplastic resin.

Accordingly, for example, even when irregularities are generated in applying a water-repellent agent to the element front surface, it is possible to prevent a water-repellent effect of the fastener element from being partially weakened. Accordingly, it is possible to more properly prevent the intrusion of a liquid into a gap formed between the left and right fastener elements 20 or a gap formed between the fastener element 20 and the waterproof tape 11 of the counterpart so that waterproof of the slide fastener 1 can be enhanced.

Next, a waterproof slide fastener according to the second embodiment of the invention is described in detail by reference to FIG. 6 and FIG. 7.

Figure 6:
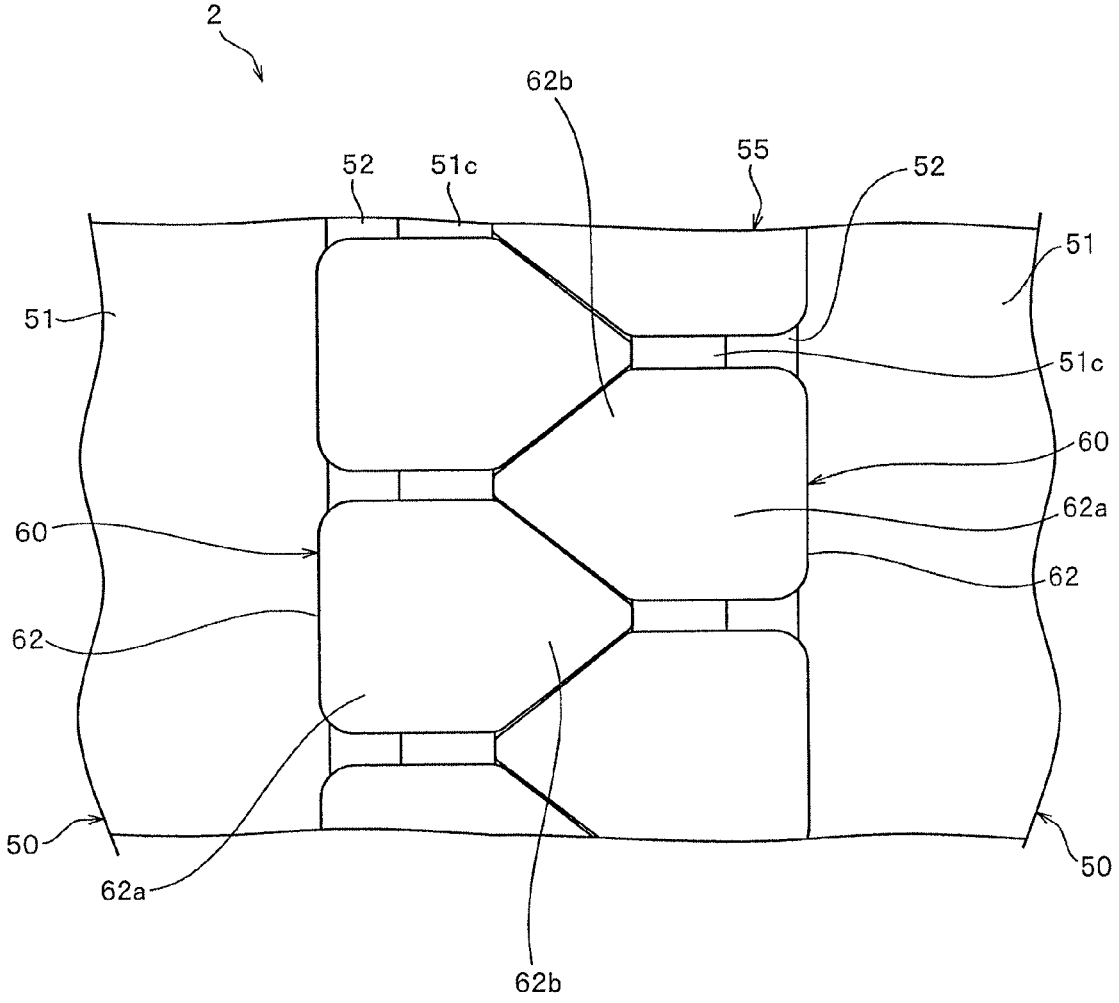
FIG. 6 is an enlarged view of an essential part showing a state where left and right element rows of a waterproof slide fastener according to a second embodiment of the invention are engaged with each other as viewed in a top plan view in an enlarged manner.
Figure 7:
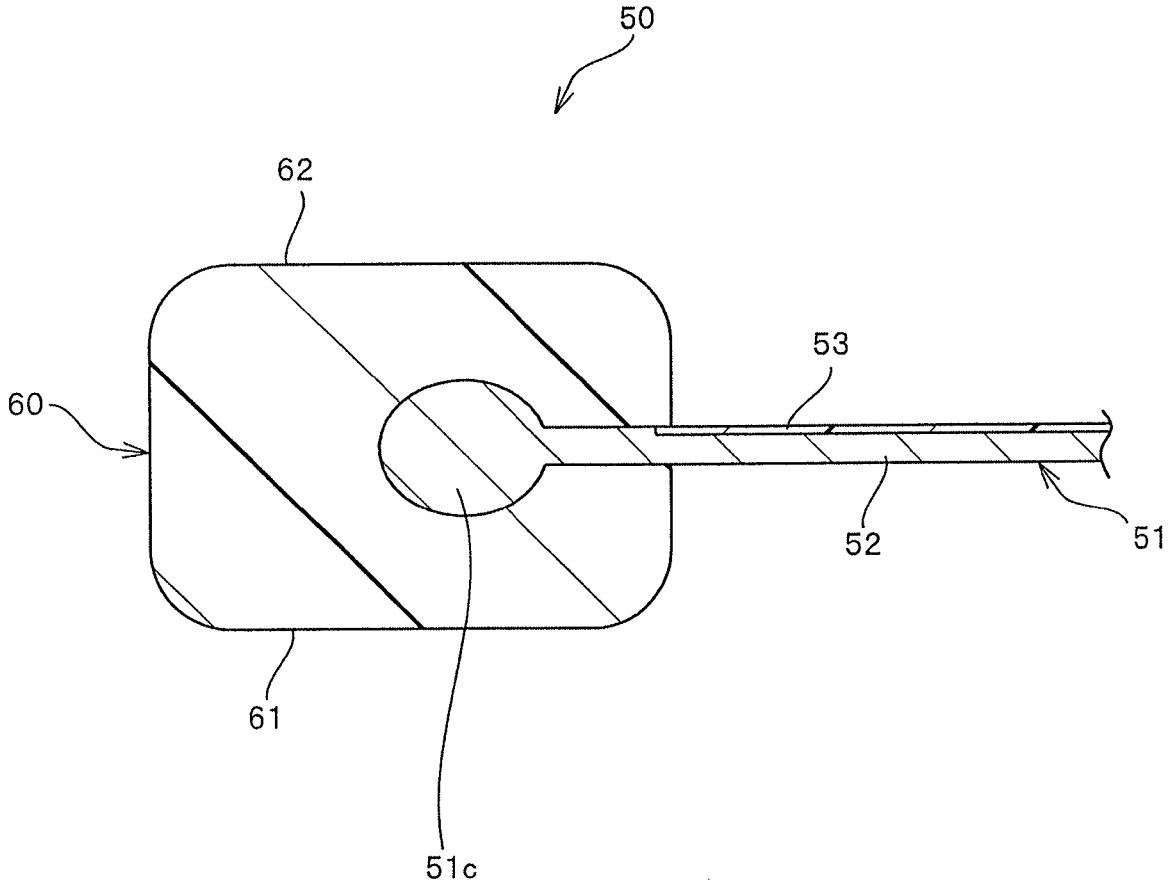
FIG. 7 is a cross-sectional view showing one fastener stringer of the waterproof slide fastener.

FIG. 6 is an enlarged view of an essential part showing a state where left and right element rows 55 of the waterproof slide fastener 2 according to the second embodiment are engaged with each other as viewed in a top plan view in an enlarged manner. FIG. 7 is a cross-sectional view showing one fastener stringer 50.

The waterproof slide fastener 2 according to the second embodiment includes: a pair of left and right fastener stringers 50 on each of which a plurality of synthetic-resin-made fastener elements 60 are formed by injection molding on the opposing tape edge portions of the waterproof tapes 51; a slider not shown in the drawing which is arranged in a slidable manner along the element rows 55 formed of the plurality of fastener elements 60; a bottom end stop not shown in the drawing which is arranged on a rear end portion side of the element rows 55; and stoppers not shown in the drawing which are arranged on a front end portion side of the element rows 55. The slider, the bottom end stop, and the stopper in the second embodiment are substantially equal to the slider 30, the bottom end stop 40, and the stopper 45 used in the above-mentioned first embodiment.

The waterproof tape 51 according to the second embodiment includes; a tape main body portion; and a tape edge portion which is arranged on an inner side of the tape main body portion. A bulged core thread portion 51*c* is arranged in a tape edge on a tape edge portion side (a tape inner side edge of the waterproof tape 51) along the tape length direction. The waterproof tape 51 includes: a fastener tape 52 formed by weaving or knitting; and a waterproof layer 53 formed on a tape front surface (second tape surface) of the fastener tape 52.

In the second embodiment, in the same manner as the above-mentioned first embodiment, the waterproof layer 53 is formed using thermoplastic elastomer in which a silicone resin or a fluorine-based resin is contained. The waterproof layer 53 is formed on the tape edge portion and the tape main body portion of the waterproof tape 51 except for a region of the waterproof tape 51 on a tape inner side edge side such that a portion of the waterproof layer 53 overlaps with the second element portion 62 of the fastener element 60.

Even when the waterproof layer 53 is not formed in the region of the waterproof tape 51 on the tape inner side edge side so that a portion of the fastener tape 52 is exposed in this manner, by imparting water a repelling effect to the whole waterproof tape 51 by applying a water-repellent agent to the whole waterproof tape 51 as described later, a liquid can be repelled at the exposed portion of the fastener tape 52. Due to such a constitution, it is possible to suppress a phenomenon that a liquid intrudes into the fastener tape 52 and leaks from a tape front surface side to a tape back surface side.

The fastener element 60 of the second embodiment includes: a first element portion 61 arranged on a tape back surface (first tape surface) side of the waterproof tape 51; and a second element portion 62 arranged on a tape front surface (second tape surface) side of the waterproof tape 51 with the tape edge portion of the waterproof tape 51 interposed between the first element portion 61 and the second element portion 62.

The first element portion 61 includes: a body portion fixedly attached to the waterproof tape 51; a neck portion continuously formed from the body portion; and a coupling head continuously formed from the neck portion. The first element portion 61 has the substantially same shape as the first element portion 21 of the fastener element 20 of the above-mentioned first embodiment.

The second element portion 62 includes: a base portion 62*a* fixedly attached to the waterproof tape 51 and having a substantially rectangular parallelepiped shape; and an element head 62*b* extending in the tape width direction from the base portion 62*a* so as to project from the tape inner side edge of the waterproof tape. The element head 62*b* of the second element portion 62 has an approximately triangular shape as viewed in a plan view where a distal end of the element head 62*b* is formed parallel to the tape length direction and an element width is decreased at a fixed ratio toward the distal end of the element head 62*b*. The element head 62*b* of the second element portion 62 has a shape different from the shape of the element head 22*b* in the above-mentioned first embodiment.

Element side surfaces (front surface and rear surface) of the element head 62*b* are not formed into an inclined surface unlike the above-mentioned first embodiment, and are arranged along the direction orthogonal to a tape surface of the waterproof tape 51 (vertical direction).

When the left and right fastener elements 60 having such second element portions 62 are engaged with each other, as shown in FIG. 6, the second element portion 62 is inserted into between the second element portions 62 of the fastener elements 60 arranged adjacent to each other of the engaging counterpart, element side surfaces of the second element portion 62 are brought into contact with the second element portions 62 of the engaging counterpart and, at the same time, a distal end of the element head 62*b* is brought into contact with a core thread portion 51*c* of the waterproof tape 51 of the engaging counterpart.

Particularly, in the case of the second embodiment, the element side surfaces of the element head 62*b* are arranged along the vertical direction as described above and hence, when the left and right fastener elements 60 are engaged with each other, it is possible to bring the element side surfaces of the second element portion 62 of each fastener element 60 in contact (face contact) with the element side surfaces of the second element portions 62 of the engaging counterpart in a wide range.

Accordingly, compared with the fastener element 20 of the first embodiment, although the fastener element 60 of the second embodiment exhibits lower flexibility (easiness of bending in the vertical direction or the lateral direction) of the waterproof slide fastener 2 when the left and right fastener elements 60 are engaged with each other, a gap is minimally formed between the left and right fastener elements 60 and hence, liquid tightness between the fastener elements 60 can be enhanced.

In the second embodiment, in the same manner as the first embodiment, the fastener element 60 is formed by injection-molding a thermoplastic resin material in which a silicone resin or a fluorine-based resin is contained at a predetermined ratio. Further, a water-repellent agent is applied to an outer surface of the waterproof tape 51 and an outer surface of the fastener element 60 by coating. Members and portions of the waterproof slide fastener 2 of the second embodiment which are not described above are formed in the substantially same manner as the corresponding members and portions of the waterproof slide fastener 1 of the first embodiment.

According to the waterproof slide fastener 2 of the second embodiment having the above-mentioned constitution, the slider is smoothly operated and, at the same time, liquid tightness between the left and right fastener elements 60 can be enhanced compared with the first embodiment and hence, it is possible to effectively prevent the intrusion of a liquid from the tape front surface side to the tape back surface side. Accordingly, the waterproof slide fastener 2 of the second embodiment can exhibit desired waterproof property in a stable manner.

Next, a waterproof slide fastener according to a third embodiment of the invention is described in detail by reference to FIG. 8 to FIG. 10.

Figure 8:
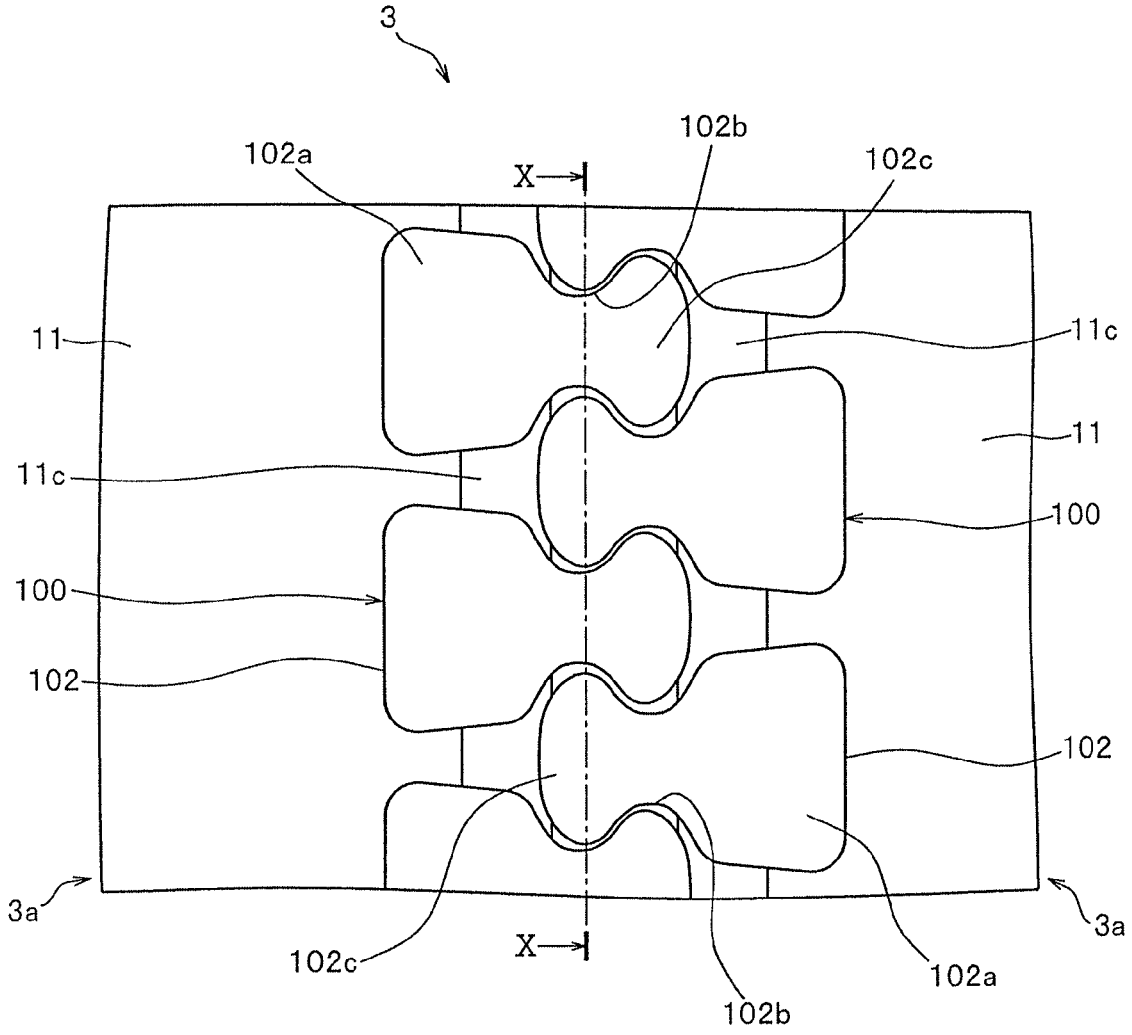
FIG. 8 is an enlarged view of an essential part showing a state where left and right element rows of a waterproof slide fastener according to a third embodiment of the invention are engaged with each other as viewed in a top plan view in an enlarged manner.
Figure 9:
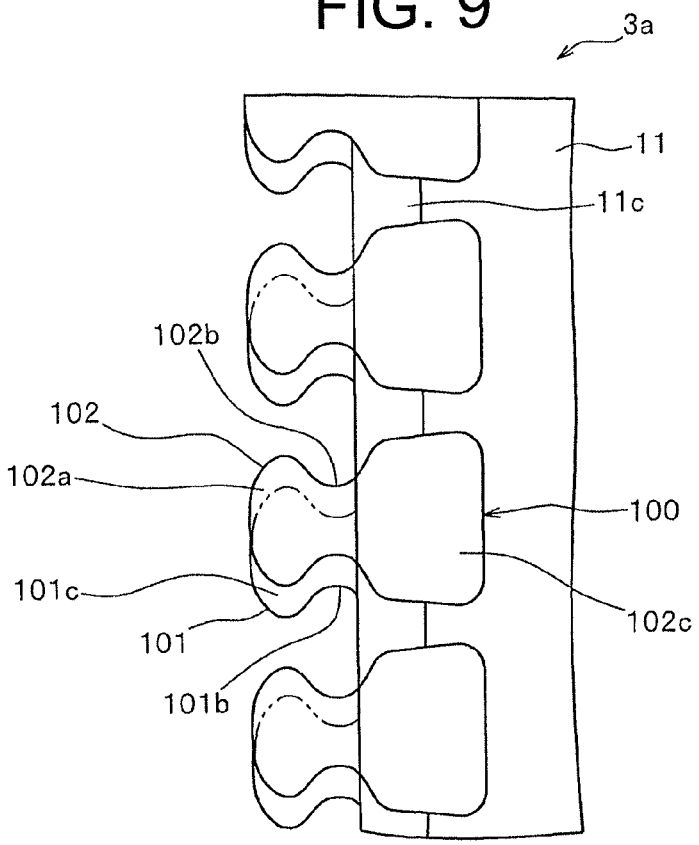
FIG. 9 is an enlarged view of an essential part showing one fastener stringer of the waterproof slide fastener.

FIG. 8 is an enlarged view of an essential part showing a state where left and right element rows of a waterproof slide fastener 3 according to the third embodiment are engaged with each other as viewed in a top plan view in an enlarged manner. FIG. 9 is an enlarged view of an essential part showing one fastener stringer. FIG. 10 is a cross-sectional view taken along line X-X in FIG. 8.

The waterproof slide fastener 3 according to the third embodiment includes: a pair of left and right fastener stringers 3*a* on which a plurality of synthetic-resin-made fastener elements 100 are formed by injection molding on the opposing tape edge portions of the waterproof tapes 11; a slider not shown in the drawing which is arranged in a slidable manner along the element rows formed of the plurality of fastener elements 100; a bottom end stop not shown in the drawing which is arranged on a rear end portion side of the element rows; and stoppers not shown in the drawing which are arranged on a front end portion side of the element rows. The waterproof tape 11, the slider, the bottom end stop, and the stopper in the third embodiment are substantially equal to the waterproof tape 11, the slider 30, the bottom end stop 40, and the stopper 45 used in the above-mentioned first embodiment.

The fastener element 100 of the third embodiment includes: a first element portion 101 arranged on a tape back surface side of the waterproof tape 11; and a second element portion 102 arranged on a tape front surface side of the waterproof tape 11 with the tape edge portion of the waterproof tape 11 interposed between the first element portion 101 and the second element portion 102.

The first element portion 101 includes: a body portion fixedly attached to the waterproof tape 11; a neck portion

101*b* continuously formed from the body portion; and a coupling head 101*c* continuously formed from the neck portion 101*b*. The first element portion 101 has the substantially same shape as the first element portion 21 of the fastener element 20 in the above-mentioned first embodiment.

The second element portion 102 includes: a body portion 102*a* fixedly attached to the waterproof tape 11; a neck portion 102*b* continuously formed from the body portion 102*a*; and a coupling head 102*c* continuously formed from the neck portion 102*b*. Although the second element portion 102 formed on the tape front surface side has the substantially same shape as the first element portion 101 formed on the tape back surface side, the second element portion 102 and the first element portion 101 are integrally connected with each other in a state where the second element portion 102 is displaced from the first element portion 101 in one direction (frontward direction) of the tape length direction by a predetermined size.

In this case, the boundary position between the first element portion 101 and the second element portion 102 is set at the same height position as the center position of the waterproof tape 11 in the tape front-and-back direction. Further, a size of an element portion of the first and second element portion 101, 102 which projects from a tape inner side edge (a size from the tape inner side edge to a distal end of the coupling head 101*c*, 102*c*) is set larger than an interval between left and right tape inner side edges which face each other in an opposed manner at the time of engaging of the left and right fastener elements 100.

Figure 10:
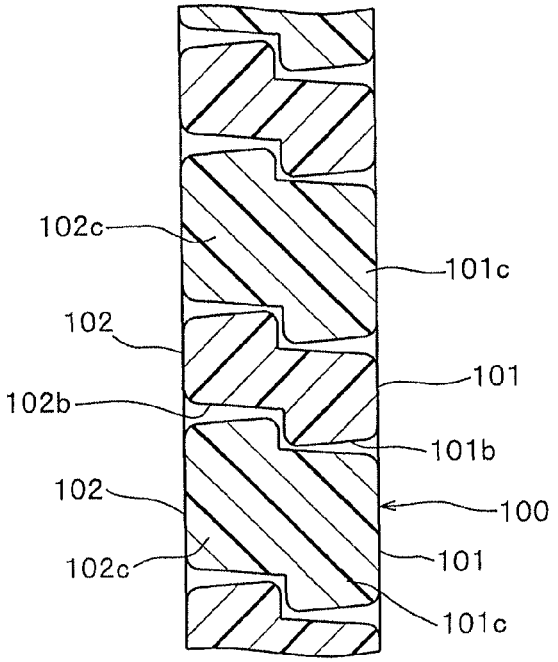
FIG. 10 is a cross-sectional view taken along line X-X in FIG. 8.

In the third embodiment, when the left and right element rows each formed of the plurality of fastener elements 100 are engaged with each other, as shown in FIG. 8 and FIG. 10, the first element portions 101 of the left and right fastener elements 100 are alternately engaged with each other in a state where the left and right waterproof tapes 11 are separated from each other and, at the same time, the second element portions 102 which are displaced from the first element portions 101 in the frontward direction are also alternately engaged with each other.

Here, the left and right first element portions 101 are alternately engaged with each other so as to cover small gaps formed between the left and right second element portion 102 engaged with each other. Further, the left and right second element portions 102 are alternately engaged with each other so as to cover small gaps formed between the left and right first element portions 101 engaged with each other. Due to such a constitution, it is possible to prevent the formation of a gap which penetrates linearly from a front surface side to a back surface side between the left and right fastener elements 100.

Further, at this time, a distal end portion of the coupling head 101*c* of the first element portion 101 and a distal end portion of the coupling head 102*c* of the second element portion 102 can be brought into contact with the core thread portions 11*c* of the waterproof tapes 11 of the engaging counterpart respectively. Particularly, in the case of the third embodiment, the distal end portions of the coupling heads 101*c*, 102*c* can be slightly pushed into the core thread portions 11*c* of the engaging counterpart.

In the third embodiment, in the same manner as the first embodiment, the fastener element 100 is formed by injection-molding a thermoplastic resin material in which a silicone resin or a fluorine-based resin is contained at a predetermined ratio. Further, a water-repellent agent substantially equal to the water-repellent agent used in the first embodiment is applied to an outer surface of the waterproof tape 11 and an outer surface of the fastener element 100 by coating. Members and portions of the waterproof slide fastener 3 of the third embodiment which are not described above are formed in the substantially same manner as the corresponding members and portions of the waterproof slide fastener 1 of the first embodiment.

According to the waterproof slide fastener 3 of the third embodiment having the above-mentioned constitution, the slider is smoothly operated and, at the same time, the waterproof slide fastener 3 exhibits both of a water-repellent effect brought about by a water-repellent agent applied to the waterproof tape 11 and the fastener element 100 by coating and a water-repellent effect brought about by a silicone resin or a fluorine-based resin contained in the fastener element 100. Accordingly, it is possible to effectively prevent the intrusion of a liquid from the tape front surface side to the tape back surface side so that the waterproof slide fastener 3 of the third embodiment can stably exhibit desired waterproof property.

EXAMPLES

A rain test B method (shower test) is applied to waterproof slide fasteners of Example 1 and Comparative examples 1 to 3 using an artificial rainfall device. Results of the shower test are described hereinafter.

As the waterproof slide fastener of Example 1, the waterproof slide fastener 1 described in the above-mentioned first embodiment is used. That is, in the waterproof slide fastener of Example 1, fastener elements are formed using polyacetal containing a silicone resin, and a fluorine-based water-repellent agent is applied by coating to waterproof tapes and fastener elements.

A chain width in the waterproof slide fastener of Example 1 is set to 5.8 mm. "Chain width" means a size in the tape width direction from a tape inner edge of a left fastener element to a tape inner edge of a right fastener element in a state where left and right element rows are engaged with each other.

On the other hand, as the waterproof slide fastener of Comparative Example 1, a waterproof slide fastener is used where fastener elements are formed using only polyacetal containing no silicone resin, and no water-repellent agent is applied to waterproof tapes and fastener elements.

As the waterproof slide fastener of Comparative Example 2, a waterproof slide fastener is used where fastener elements are formed using polyacetal containing a silicone resin, and no water-repellent agent is applied to waterproof tapes and fastener elements.

As the waterproof slide fastener of Comparative Example 3, a waterproof slide fastener is used where a fluorine-based water-repellent agent is applied to waterproof tapes and fastener elements, and fastener elements are formed using only polyacetal containing no silicone resin.

In the waterproof slide fasteners of Comparative Examples 1 to 3, the constitution is substantially equal to the corresponding constitution of the waterproof slide fastener of Example 1 except for the presence or non-presence of a silicone resin contained in a fastener element 60, and the presence or non-presence of a water-repellent agent applied to waterproof tapes 51 and the fastener elements 60.

Three specimens are prepared with respect to each one of the waterproof slide fasteners of Example 1 and Comparative Examples 1 to 3 having the above-mentioned constitution, and the shower test using a rain test B method is performed with respect to the respective specimens. The rain test B method which is performed with respect to the respective specimens is specifically described.

Figure 11:
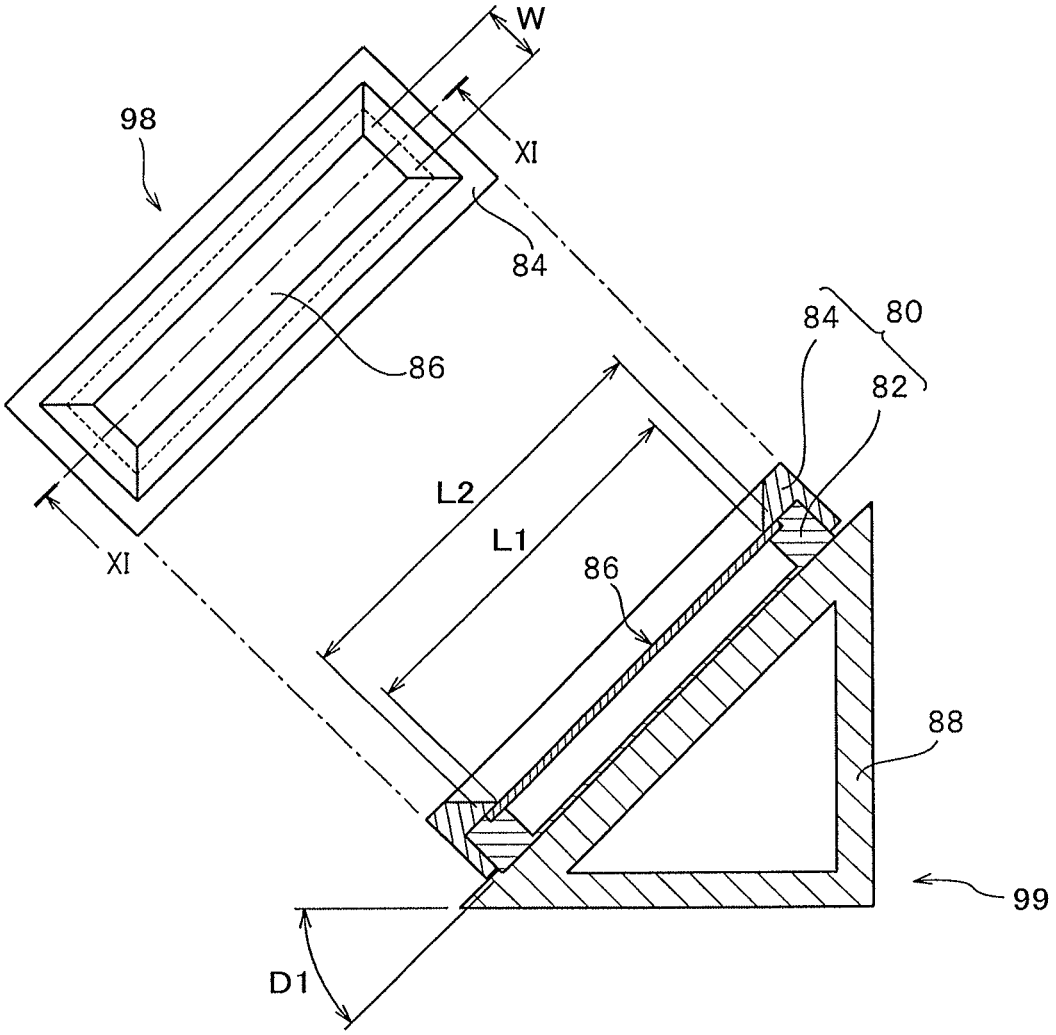
FIG. 11 is a plan view 98 and is also a cross-sectional view (a cross-sectional view XI-XI) 99 of a fixing jig of a specimen used in a rain test B method.

Firstly, a fixing jig for fixing the specimen used in the rain test B method is described by reference to FIG. 11. A fixing jig 80 for fixing a specimen 86 of the waterproof slide fastener includes: an opening member 84 having an open window for allowing water supplied from above to impinge on the specimen 86; and a water storage member 82 arranged below the opening member 84 and having a water storing portion for storing moisture which permeates the specimen 86.

In the fixing jig 80, the specimen 86 is set at a predetermined position in a state where the specimen 86 is clamped between the opening member 84 and the water storage member 82. To maintain the specimen 86 in a predetermined inclined state while preventing the specimen 86 from being immersed into water, in the rain test B method, the shower test is performed in a state where the fixing jig 80 is inclined at an angle of 45° (D1) using an angle fixing device 88. As shown in FIG. 11, a size of the open window of the opening member 84 is set such that a window length (L1) is 200 mm, and a window width (W) is 15 mm. Further, a length of the specimen 86 (a size in the tape length direction, (L2) is 250 mm.

Figure 12:
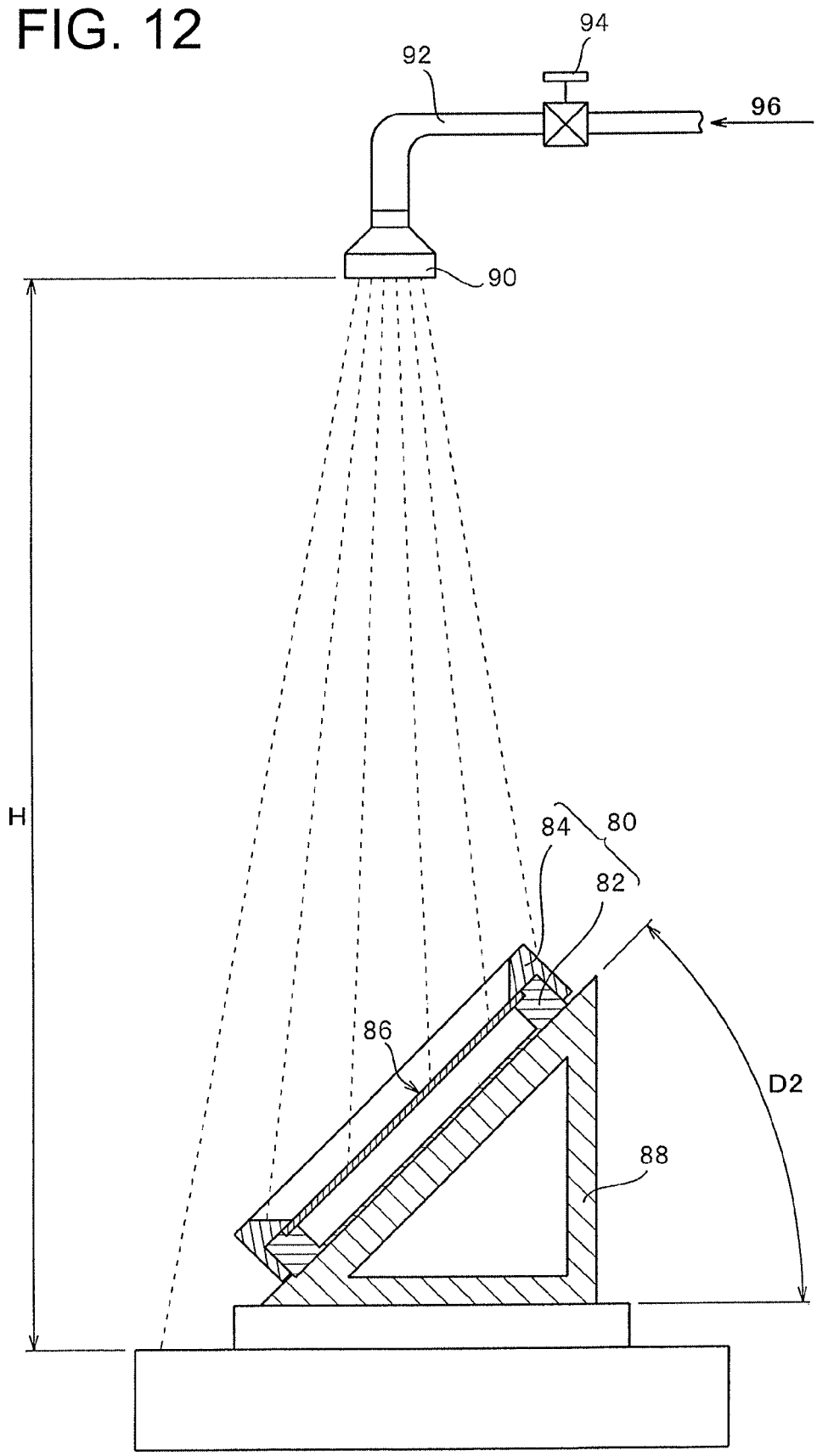
FIG. 12 is a view showing an external appearance of an artificial rainfall device at the time of performing the rain test B method.
Figure 13:
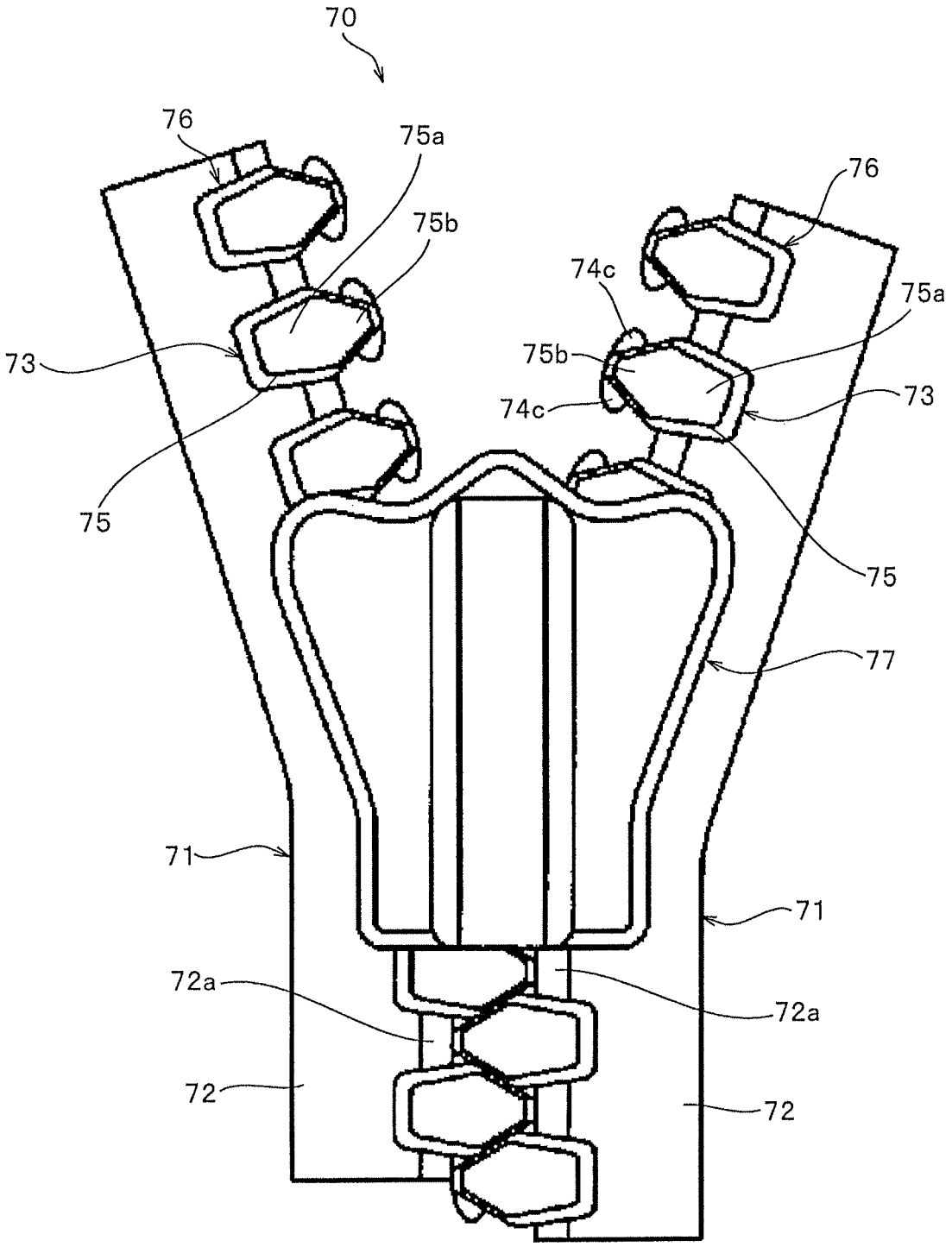
FIG. 13 is a plan view showing a conventional waterproof slide fastener.
Figure 14:
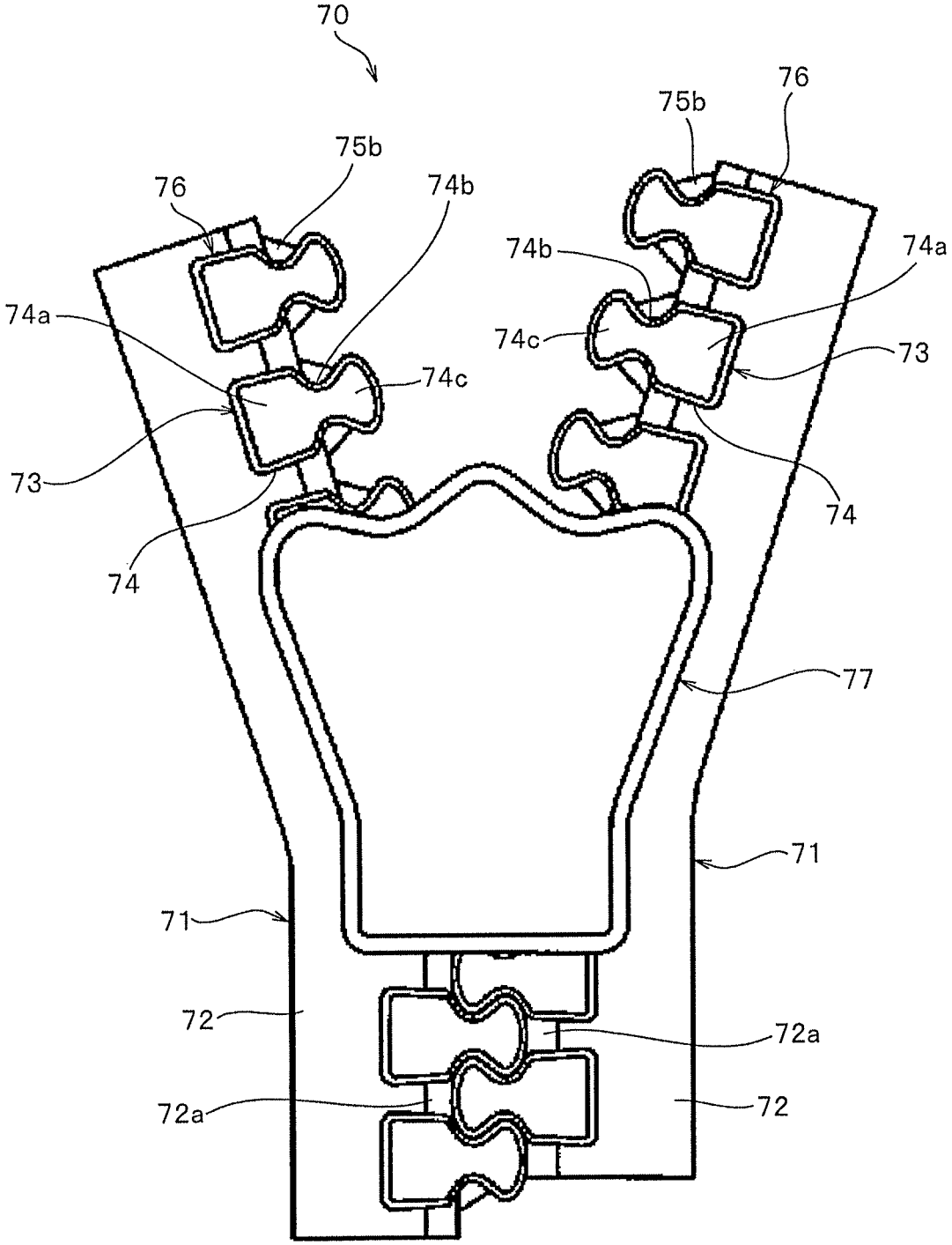
FIG. 14 is a bottom view of the waterproof slide fastener.

FIG. 12 is a view showing an external appearance of an artificial rainfall device at the time of performing the rain test B method. The fixing jig 80 and the angle fixing device 88 are shown in cross section. As shown in FIG. 12, the fixing jig 80 where the specimen 86 is clamped is attached to the angle fixing device 88, and is held in a state where the fixing jig 80 is inclined at an angle of 45° (D2) with respect to the horizontal direction. A spray nozzle 90 for spraying water is arranged at a position 2000 mm (H) above the fixing jig 80. A water supply pipe 92 is connected to the spray nozzle 90, and water (96) is supplied under pressure to the inside of the spray nozzle 90. A water amount adjusting valve 94 for adjusting an amount of water to be sprayed is arranged in a middle portion of the pipe 92.

In performing the rain test B method, the specimen 86 of the waterproof slide fastener is cut to a length of 250 mm, and a mass (M0) of the specimen 86 before the shower test is measured in advance. Then, the specimen 86 is set at a predetermined position in the fixing jig 80 by clamping the specimen 86 between the opening member 84 and the water storage member 82. At the same time, a blotting paper is prepared for measuring a mass of water which permeates the specimen 86 by absorbing water remained in the inside of the water storage member 82 after the test is finished. A mass (M1) of the blotting paper in an original state is measured in advance.

Next, the fixing jig 80 where the specimen 86 is clamped is attached to the angle fixing device 88, is held at an angle of 45°, and is arranged at a position 2000 mm (H) below the spray nozzle 90. Subsequently, the shower test is performed with respect to the specimen 86 in such a manner that water is sprayed to the fixing jig 80 from the spray nozzle 90, and an amount of rainfall is controlled to 100 mm/h by adjusting the water amount adjusting valve 94 while observing a rain gauge. The water spraying is stopped after a lapse of 15 minutes from the start of the water spraying with respect to the specimen 86.

After the shower test is finished by stopping the water spraying, firstly, the specimen 86 is removed from the fixing jig 80, and a mass (M2) of the specimen 86 after the test is measured. Then, the blotting paper is immersed into water remaining in the inside of the water storage member 82 thus absorbing all water remaining in the inside of the water storage member 82. Then, a mass (M3) of the blotting paper after absorbing water is measured.

Thereafter, an intrusion amount of water in the rain test B method is calculated using a calculation formula "intrusion amount (g)=(M2−M0)+(M3−M1)". By calculating an intrusion amount of water in the rain test B method with respect to three prepared specimens of the each waterproof slide fastener, the waterproof slide fasteners of Example 1 and Comparative Example 1 to 3 are compared with each other with respect to waterproof property.

Results of calculation of an intrusion amount of water in the above-mentioned rain test B method with respect to the respective specimens and average values of the intrusion amounts of the respective waterproof slide fasteners obtained from the results are shown in following Table 1.

TABLE 1

| | Example 1 | Comparative Example 1 | Comparative Example 2 | Comparative Example 3 |
|---|---|---|---|---|
| Specimen 1 (g) | 0.10 | 7.14 | 6.58 | 0.13 |
| Specimen 2 (g) | 0.03 | 7.14 | 6.87 | 0.10 |
| Specimen 3 (g) | 0.07 | 6.87 | 6.47 | 0.12 |
| Average (g) | 0.07 | 7.05 | 6.64 | 0.12 |

As shown in the above-mentioned Table 1, an intrusion amount of water can be suppressed to a low value in the waterproof slide fastener of Example 1 compared with the waterproof slide fasteners of Comparative Examples 1 to 3 so that it is confirmed that the waterproof slide fastener of Example 1 exhibits excellent waterproof property. Particularly, when the fixing jig 80 is observed after the shower test is performed with respect to the specimen of the waterproof slide fastener of Example 1, almost no water remains in the inside of the water storage member 82. Accordingly, it is considered that most of an intrusion amount of water calculated with respect to Example 1 is an amount of moisture which intrudes into or is held by the waterproof slide fastener.

Accordingly, when such a waterproof slide fastener of Example 1 is attached to an opening or opening/closing portion of a product such as a bag or clothing, for example, it is possible to effectively prevent the intrusion of a liquid such as water into the inside of the product from the outside of the product through the opening or the opening/closing portion by closing the waterproof slide fastener.

Also with respect to the waterproof slide fasteners according to the above-mentioned second embodiment and third embodiment, in the same manner as the first embodiment, three specimens of Example 1 and Comparative Examples 1 to 3 are prepared, a shower test is performed using the rain test B method, and an intrusion amount of water is calculated. As a result, an intrusion amount of water in the waterproof slide fastener of Example 1 is smaller than intrusion amounts of water in the waterproof slide fasteners of the Comparative examples 1 to 3.

REFERENCE SIGNS LIST

1, 2, 3: waterproof slide fastener
3*a*: fastener stringer
10: fastener stringer
11: waterproof tape
11*a*: tape main body portion
11*b*: tape edge portion
11*c*: core thread portion
12: fastener tape
13: waterproof layer
15: element row
20: fastener element
21: first element portion
21*a*: body portion

21*b*: neck portion
21*c*: coupling head
21*d*: raised portion
22: second element portion
22*a*: base portion
22*b*: element head
23*a*: first gradually decreasing portion
23*b*: second gradually decreasing portion
23*c*: stepped portion
30: slider
31: slider body
32: tab
40: bottom end stop
41: separable pin
42: box pin
43: box
45: stopper
50: fastener stringer
51: waterproof tape
51*c*: core thread portion
52: fastener tape
53: waterproof layer
55: element row
60: fastener element
61: first element portion
62: second element portion
62*a*: base portion
62*b*: element head
80: fixing jig
82: water storage member
84: opening member
86: specimen
88: angle fixing device
90: spray nozzle
92: pipe
94: water amount adjusting valve
96: water
98: plan view
99: XI-XI cross-sectional view
100: fastener element
101: first element portion
101*b*: neck portion
101*c*: coupling head
102: second element portion
102*a*: body portion
102*b*: neck portion
102*c*: coupling head

The invention claimed is:

1. A waterproof slide fastener including:

a pair of fastener stringers where a plurality of synthetic-resin-made fastener elements are attached to opposing tape edge portions of left and right waterproof tapes having a synthetic-resin-made waterproof layer on at least one of first and second tape surfaces; and a slider which is attached to element rows each of which is formed of the plurality of fastener elements, wherein each of the left and right fastener elements has an engaging portion which engages with the fastener element of an engaging counterpart, projects from a tape edge of the waterproof tape and is brought into contact with the tape edge portion of the engaging counterpart at the time of engaging of the element rows wherein a silicone resin or a fluorine-based resin is contained in the fastener elements, and a water repellant agent is applied to the waterproof tape and the fastener elements, and a content of the silicone resin or the fluorine-based resin in the fastener elements is set to 0.2 weight % or more and less than 1.5 weight %.

2. The waterproof slide fastener according to claim 1, wherein the fastener element includes: a first element portion arranged on a first tape surface side of the waterproof tape, and a second element portion arranged on a second tape surface side of the waterproof tape and having a shape different from the first element portion, the engaging portion is arranged on the first element portion, and the second element portion includes an element head which projects from the tape edge of the waterproof tape, is inserted between the fastener elements arranged adjacent to each other of the engaging counterpart and is brought into contact with the tape edge portion of the waterproof tape at the time of engaging of the element rows.

3. The waterproof slide fastener according to claim 1, wherein a silicone resin or a fluorine-based resin is contained in the waterproof layer.

* * * * *